US009129790B2

(12) United States Patent
Welkie

(10) Patent No.: US 9,129,790 B2
(45) Date of Patent: Sep. 8, 2015

(54) ORTHOGONAL ACCELERATION TOF WITH ION GUIDE MODE

(71) Applicant: PerkinElmer Health Sciences, Inc., Waltham, MA (US)

(72) Inventor: David G. Welkie, Trumbull, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 14/209,982

(22) Filed: Mar. 13, 2014

(65) Prior Publication Data

US 2014/0264005 A1 Sep. 18, 2014

Related U.S. Application Data

(60) Provisional application No. 61/781,850, filed on Mar. 14, 2013.

(51) Int. Cl.

| | |
|---|---|
| ***H01J 49/00*** | (2006.01) |
| ***H01J 49/40*** | (2006.01) |
| ***H01J 49/06*** | (2006.01) |

(52) U.S. Cl.

CPC ..... *H01J 49/401* (2013.01); *H01J 49/062* (2013.01)

(58) Field of Classification Search

USPC ..... 250/281, 282, 286, 287

See application file for complete search history.

(56) References Cited

U.S. PATENT DOCUMENTS

| | | | | |
|---|---|---|---|---|
| 5,763,878 | A | 6/1998 | Franzen | |
| 2003/0141447 | A1 * | 7/2003 | Verentchikov et al. | 250/287 |
| 2004/0251411 | A1 * | 12/2004 | Bateman et al. | 250/293 |
| 2006/0016983 | A1 | 1/2006 | Kobayashi | |
| 2006/0038121 | A1 | 2/2006 | Guevremont | |
| 2006/0284072 | A1 | 12/2006 | Hashimoto et al. | |
| 2010/0072362 | A1 | 3/2010 | Giles et al. | |
| 2012/0091331 | A1 | 4/2012 | Badiel et al. | |

OTHER PUBLICATIONS

Bateman et al., "A Combined Magnetic Sector—Time-of-Flight Mass Spectrometer for Structural Determination Studies by Tandem Mass Spectrometry," Rapid Communications in Mass Spectrometry, 9:1227-1233 (1995).

Coles and Guilhaus, "Orthogonal acceleration—a new direction for time-of-flight mass spectrometry: fast, sensitive mass analysis for continuous ion sources," trends in analytical chemistry, 12(5):203-213 (1993).

(Continued)

*Primary Examiner* — Nicole Ippolito

*Assistant Examiner* — Hanway Chang

(74) *Attorney, Agent, or Firm* — Fish & Richardson P.C.

(57) ABSTRACT

Mass spectrometry systems include an electronic controller and a time-of-flight mass analyzer in communication with the electronic controller. The time-of-flight mass analyzer includes a pulsing region defining a channel that extends along an axis. The pulsing region includes: a first electrode extending along the axis, the first electrode defining one or more apertures; a second electrode extending along the axis, the first and second electrodes being positioned on opposing sides of the axis in a first direction perpendicular to the axis. The electronic controller is programmed to apply a first set of voltages to the electrodes to constrain a motion of ions propagating along the axis in a radial direction relative to the axis, and apply a second set of voltages to the electrodes to accelerate the ions out of the pulsing region through the one or more apertures.

29 Claims, 13 Drawing Sheets

(56) References Cited

OTHER PUBLICATIONS

Dawson and Guilhaus, "Orthogonal-acceleration Time-of-flight Mass Spectrometer," Rapid Communications in Mass Spectrometry, 3(5):155-159 (1989).

Michael et al., "An ion trap storage/time-of-flight mass spectrometer," Rev. Sci. Instrum., 63(1):4277-4284 (1992).

Wiley and McLaren, "Time-of-Flight Mass Spectrometer with Improved Resolution," The Review of Scientific Instruments, 26(12):1150-1157 (1955).

International Search Report and Written Opinion issued in PCT/IB2014/60185 on Sep. 12, 2014.

* cited by examiner

ORTHOGONAL ACCELERATION TOF WITH ION GUIDE MODE

CLAIM OF PRIORITY

This application claims priority under 35 USC §119(e) to Provisional Patent Application Ser. No. 61/781,850, filed on Mar. 14, 2013, the entire contents of which are hereby incorporated by reference.

TECHNICAL FIELD

This invention relates to orthogonal acceleration time-of-flight mass analyzers.

BACKGROUND

Orthogonal acceleration time-of-flight (OA-TOF) mass analyzers are configured to pulse-accelerate a segment of an incoming 'primary' ion beam from a pulsing region into a TOF drift tube for TOF mass analysis. Typically, a 'primary' ion beam enters an OA pulsing region while this region is nominally free of electric fields during an ion 'filling' period, and a segment of the beam is then pulse-accelerated in a direction orthogonal to the axis of the incoming beam by switching on an acceleration field that is constant within this region, via abrupt application of voltages to planar electrodes that border this region. Since no force is applied to the ions in the primary beam axial direction, the ions continue their motion in the primary beam axis direction as they travel through the TOF flight tube, eventually arriving at a detector that is positioned some distance away from the pulsing region in the primary beam axis direction. As such, OA-TOF analyzers have become popular because of their ability to accommodate ion beams from continuous ion sources, such as electron ionization ion sources, electrospray ion sources, upstream RF ion guides including collision cells, etc., as well as pulsed ion sources, such as upstream ion guides operated in a trap/release mode, atmospheric or intermediate pressure MALDI sources, etc. OA-TOF mass analyzers have proven to be especially useful in this regard as chromatographic detectors.

The achievable resolving power and sensitivity of OA-TOF mass analyzers depend in large part on the distribution of initial ion velocities and spatial positions of the ion beam segment in the OA pulsing region, as measured in the direction of the orthogonal acceleration. Minimizing these distributions, and compensating and mitigating the impact of such distributions on measured ion flight times, are typically primary objectives of OA-TOF instrument design. In particular, very good time-focusing of such distributions are now common owing in large part, firstly, to incorporation of multiple-stages of acceleration, which, as in the original design by Wiley and McLauren, typically composed of two sequential regions of differing constant electric field strength, which exhibit very good spatial focusing characteristics; and, secondly, to devices that compensate for ion velocity dispersions, such as 'reflectron' electrostatic mirrors. With respect to minimizing the initial ions' spatial and velocity distributions in the first place, it is generally recognized that optimum performance results when the incoming ion beam is as collimated as possible, corresponding to minimization of the ions' velocity components orthogonal to the primary beam axis, even at the expense of broadening the ions' initial spatial distribution in the incoming ion beam. Often, ion kinetic energies are cooled by collisions with background gas in an upstream ion guide prior to transfer into the OA pulsing region, in order to achieve better beam collimation and smaller beam size.

Apart from such measures, instrument performance generally improves with increasing size, greater operating voltages, and through the utilization of higher-performance components, such as high time resolution detectors and data acquisition systems. However, such trends are typically accompanied by a corresponding increase in instrument cost, complexity, maintenance and/or installation requirements. As such, it is often desirable, at least economically, to instead configure an OA-TOF analyzer that is relatively compact, operates with more modest voltages, and incorporates moderately-priced components. This is generally the case with relatively low cost bench-top configurations, which, nevertheless, are desired to provide performance that complies with the intended usage requirements.

These latter types of compact OA-TOF instruments are typically configured with minimal distance between the OA pulsing region and the TOF detector, as measured along the incoming primary beam axis, in order to minimize the corresponding instrument dimension. The necessary primary beam kinetic energy is determined by this distance once the ions' flight time in the flight tube is established by the flight length and flight tube voltage, since the time the ions spend in the flight tube should match the time the ions travel along the primary beam axis direction in order that they arrive at the location of the detector at the end of their flight. Therefore, as the distance between the pulsing region and the detector is reduced, the primary ion beam kinetic energy should be reduced as well. Since the necessary primary beam kinetic energy varies with the square of this distance, the reduction in primary beam kinetic energy is more severe than the corresponding reduction in pulsing region-detector distance. For example, if this distance is reduced to 0.75 of its original value, then the primary beam kinetic energy should be reduced to $0.75^2$, or 0.5625 of its original value.

A lower flight tube voltage is also attractive for such instruments, not only because of reduced cost of power supplies and other components, but also because a lower flight tube voltage increases the difference in flight times between neighboring m/z peaks in a mass spectrum, which mitigates the demand for high time resolution of the acquisition electronics, thereby allowing lower cost electronics to be employed effectively as well. This is especially significant when the length of the flight tube is also reduced to achieve a more compact instrument, since shortening the flight tube length results in corresponding reduction of ion flight times, and in reduction of the separation in time between neighboring peaks. However, lowering the flight tube voltage also mandates a corresponding proportional reduction in the required primary ion kinetic energy as the ions enter the pulsing region, again, to ensure that ions hit the detector, other factors being equal.

Now, as the primary ion kinetic energy decreases, to accommodate a lower flight tube voltage and/or a shorter pulse region-detector distance, the ions become increasingly more difficult to focus into a well-collimated beam, or at least into a beam that remains well-collimated across the entire pulsing region, due to an increasing sensitivity of ions' trajectories to various 'disturbing forces', such as focus lens aberrations; stray electric fields; space charge electric fields due to charge deposition on patches of low-electrical conductance; repulsive Coulomb forces within the ion beam; field penetration through grids; and/or electrical noise on focus electrodes from power supplies. Degradation in the degree of beam collimation in the pulsing region that can be achieved as the primary beam kinetic energy is reduced, results in diminished performance capabilities. Consequently, the degree to which the primary beam ion kinetic energy can be reduced is constrained by the minimum performance that is desired, and this constraint, in turn, limits the extent to which efficiencies of space and cost can be achieved in conventional OA-TOF instruments.

SUMMARY

OA-TOF instruments are disclosed that allow a primary ion beam kinetic energy in an OA-TOF pulsing region to be reduced to values that are substantially lower than are typically employed in conventional OA-TOF instruments, while nevertheless providing practical m/z resolving power and sensitivity. Lower primary beam kinetic energy with practical resolving power and resolution is achieved by providing orthogonal acceleration optics that are configured to operate as a conventional orthogonal pulse acceleration region with a constant uniform pulse acceleration field, but which also operate alternately as an RF ion guide between periods of pulse acceleration to guide low energy ions into the pulsing region. In other words, during the time periods when conventional orthogonal acceleration configurations would be operated in the field-free ion 'filling' mode, the orthogonal acceleration configuration of the subject invention provides a mode of operation, during which radial RF fields are generated within the pulsing region to constrain the motion of ions in directions radial to the primary ion beam axis, similar to the operation of conventional RF ion guides. This capability allows the axial ion kinetic energy of the incoming primary beam ions to be reduced substantially below values that would be impractical with prior art orthogonal acceleration configurations, because the 'guiding' action of the RF fields dominates over any of the aforementioned 'disturbing forces'. This ensures that ions remain close to the primary beam axis while they continuously move with the much lower axial kinetic energies into and through the pulsing region. Then, the pulsing region operation switches abruptly from an ion guiding mode to a pulse acceleration mode to pulse accelerate a segment of the ion beam into the TOF flight tube. Accordingly, a pulse acceleration electric field with an essentially uniform constant electric field is provided, which maintains good spatial focusing properties for an ion beam with a finite-size diameter, as in conventional OA configurations. The ions in the pulsed ion beam segment continue to move along the primary beam axis direction with the same axial kinetic energy they had as they traversed the pulsing region until they impact the detector. Instead of returning to a field-free region, however, as with conventional OA configurations, the operating mode returns to the RF ion guide mode to allow a subsequent portion of the primary beam ions to enter the pulsing region, and the cycle repeats for each subsequent TOF mass analysis. The lower primary beam axial kinetic energies that are accommodated in an OA-TOF pulsing region allows the pulsing region and detector to be located closer together, and/or allows the flight tube voltage to be reduced, thereby enabling a lower-cost, more compact OA-TOF mass analyzer than has been otherwise practical.

In certain embodiments, an OA pulsing region has a square open-area internal cross-section, with a 'square' edge of length of S, and extending longitudinally along, and centered on, the primary beam axis for at least the length of the pulsing region. The square open-area cross-section is oriented such that one side of the square includes a flat plate electrode having a face oriented perpendicular to, and upstream of, the pulse acceleration direction, and so would often be designated a 'pusher' electrode in conventional OA geometries. The opposite side of the square also includes a flat plate electrode, but at least a portion of which includes a grid or slot through which ions may pass from the primary beam axis toward the TOF flight tube when the TOF acceleration pulse occurs. This electrode is then analogous to a 'puller' grid electrode in the conventional OA geometries. These 'pusher' and 'puller' electrodes are separated by the distance S, and are each spaced from the primary beam axis in the pulse-acceleration direction by a distance S/2. The other two sides of the square open-area internal cross-section are each composed of one or more flat planar electrodes that together, along with small gaps between them, span the distance between the 'pusher' and 'puller' electrodes along the orthogonal edges of the square, and which also extend longitudinally along the primary beam axis at least the length of the pulsing region. In the RF ion guide mode, each set (that is, each set comprising one side of the square) of these one or more 'intermediate' electrodes are operated as a single electrode during the RF ion guide mode of operation, in that they all have the same RF voltage and phase applied simultaneously as if they were connected together during this operating mode. In fact, during this RF operating mode, all of the 'intermediate' electrodes on both sides of the 'square' are operated with the same RF voltage and phase. Similarly, both the 'pusher' and 'puller' electrodes are also operated preferably, but not necessarily, with essentially the same RF voltage as the 'intermediate' electrodes, but with an RF phase that is 180 degrees opposite from the RF phase applied to the 'intermediate' electrodes. Therefore, this OA configuration and operation functions as a conventional RF quadrupole ion guide having flat electrodes arranged equally spaced in a square pattern and centered on an ion guide axis. In the implementation described herein, the ion guide axis coincides with the primary beam axis, and primary beam ions are guided along the axis as they traverse this pulsing region configuration during the 'filling' period.

When the time comes to pulse accelerate a segment of this ion beam into the TOF flight tube for m/z analysis, the RF voltages are essentially completely removed from the pulsing region electrodes, and the voltages on all these electrodes are simultaneously switched abruptly to DC voltages as necessary to generate an essentially homogeneous, constant pulse acceleration field between the 'pusher' and 'puller' electrodes. The homogeneity of the pulse acceleration field may be important so that ions located off the primary beam axis experience the same field and are time-focused at the TOF detector, as in a conventional OA-TOF configuration. Therefore, while preferable, it is not necessary that the ion beam be very tightly constrained to essentially a fine 'thread' of a beam having negligible radial dimensions in order to achieve good performance. Once ions have cleared the pulsing region, the voltages on the pulsing region electrodes return to the RF voltages described above to allow the next ion beam segment to enter the pulsing region.

Various embodiments are possible that include the basic concept described above. For example, it is possible to utilize different numbers, dimensions, and spacings between the 'intermediate' electrodes while remaining within the scope of the invention. Also, other ion guide electrode arrangements are possible besides the preferred quadrupole arrangement, such as hexapole, octupole, and more than eight electrodes, each configuration including such electrodes arranged equally spaced about a common ion guide axis. In each case, the pulse DC voltages applied to the electrodes during the pulse acceleration stage are adjusted to achieve the most homogeneous acceleration field possible during this operating mode. Any or all of these voltages may optionally be configured as adjustable in order to ensure a homogeneous pulse-acceleration field. Also, the potential on the axis may be zero volts by applying equal but opposite polarity pulse voltages to the 'pusher' and 'puller' electrodes, respectively. Alternatively, the magnitude of these pulse voltages may be adjusted symmetrically to establish a non-zero potential on the axis if desired. In this case, the pulse voltages applied to the intermediate electrodes are also adjusted accordingly to maintain a homogeneous pulse-acceleration field during the pulse acceleration period.

The primary ion beam may be transferred into the pulsing region directly from upstream RF ion guides, or from electrostatic lens arrangements, or from a combination thereof, or from any other known ion transport device. Any upstream ion guide may be configured with the same or different form factor, that is, with the same or different number of electrodes, dimensions, and/or rotational orientation, as the ion guide configuration of the pulsing region of the invention, and any upstream ion guide may be operated with the same or different values of any of the RF voltage, frequency and/or phase, as the pulsing region ion guide.

In some embodiments, one may apply a common voltage offset to all electrodes of the pulsing region during the ion 'filling' period, so as to accelerate or decelerate ions as they pass into the OA region, prior to pulse acceleration towards the TOF flight tube. Alternatively, or additionally, one may provide the option of a DC voltage differential between the pulsing region electrodes, simultaneous with the RF voltage applied to each electrode during the ion 'filling' period, in some embodiments, in order to provide lateral 'steering' of the incoming ion beam to ensure that the ion beam remains concentric with the OA region ion guide axis, that is, by counteracting any field penetration into the pulsing region by external fields.

Various aspects of the invention are summarized as follows:

In general, in one aspect, the invention features systems that include an electronic controller and a time-of-flight mass analyzer in communication with the electronic controller. The time-of-flight mass analyzer includes a pulsing region defining a channel that extends along an axis. The pulsing region includes: a first electrode extending along the axis, the first electrode defining one or more apertures; a second electrode extending along the axis, the first and second electrodes being positioned on opposing sides of the axis in a first direction perpendicular to the axis; a third electrode extending along the axis; and a fourth electrode extending along the axis, the third and fourth electrodes being positioned on opposing sides of a plane defined by the axis and the first direction. The electronic controller is programmed to apply a first set of voltages to the electrodes to constrain a motion of ions propagating along the axis in a radial direction relative to the axis, and apply a second set of voltages to the electrodes to accelerate the ions out of the pulsing region through the one or more apertures.

Embodiments of the system may include one or more of the following features and/or features of other aspects. For example, the ions can be accelerated in the first direction.

The system can include one or more additional pairs of electrodes extending along the axis (e.g., extending parallel to the axis), each pair including electrodes on opposite sides of the plane.

The first set of voltages can include RF voltages. The RF voltages applied to the first and second electrodes can be in phase with each other. The RF voltages applied to the third and fourth electrodes can be in phase with each other. The RF voltages applied to the first and second electrodes can be out of phase (e.g., 180° out of phase) with the RF voltages applied to the third and fourth electrodes. The RF voltages can have square waveforms or sinusoidal waveforms. The RF voltages applied to the one or more additional pairs of electrodes can be in phase with the RF voltages applied to the third and fourth electrodes.

The second set of voltages can include DC voltages that establish a potential gradient in the first direction.

The electronic controller can be programmed to sequentially apply the first set of voltages and then the second set of voltages to the electrodes.

The RF voltages applied can reduce oscillations of a potential at the axis relative to a mode of operation in which the first set of voltages is not applied. The RF voltages applied can reduce a kinetic energy distribution of the ions entering the pulsing region relative to a mode of operation in which the first set of voltages is not applied. The electronic controller can be configured to symmetrically adjust a magnitude of voltages to obtain a non-zero potential on the axis. The RF voltages applied can maintain the axis field-free and at a constant potential. The RF voltages applied can maintain a concentric cross-section of the ions propagating along the axis.

In general, in another aspect, the invention features methods that include directing ions into a channel extending along an axis in a pulsing region of a time-of-flight mass analyzer, applying RF voltages to electrodes extending along the axis to constrain a motion of the ions in a radial direction relative to the axis, and applying DC voltages to the electrodes to accelerate the ions out of the pulsing region in a direction orthogonal to the axis.

Embodiments of the system may include one or more of the following features and/or features of other aspects. For example, applying the RF voltages can include applying in-phase voltages to a first pair of electrodes positioned on opposing sides of the axis in a first direction perpendicular to the axis. Applying the RF voltages can further include applying in-phase voltages to a second pair of electrodes positioned on opposing sides of a plane defined by the axis and the first direction.

In some embodiments, a first of the electrodes include one or more apertures (e.g., formed by a grid or slits) through which the ions exit the pulsing region.

The method can include detecting the ions accelerated out of the pulsing region. The ions can travel to the detector through a flight tube.

The RF and DC voltages can be repeatedly sequentially applied to the electrodes to direct a series of packets of ions out of the pulsing region.

In general, in another aspect, the invention features mass spectrometry systems that include an ion source, a time-of-flight analyzer assembly including a pulsing region, a flight tube and a detector, an ion transport assembly arranged to receive ions from the ion source and direct the ions to the pulsing region of the time-of-flight analyzer assembly, and an electronic controller in communication with the time-of-flight analyzer assembly. During operation the electronic controller causes the pulsing region to operate sequentially in a first mode, in which ions in the ion beam are confined to trajectories along an axis of the pulsing region, and a second mode, in which the ions are accelerated in a direction orthogonal to the axis into the flight tube.

Embodiments of the system may include one or more of the following features and/or features of other aspects. For example, the ion transport assembly includes one or more ion guides. The one or more ion guides can include one or more multipole ion guides.

The ion transport assembly and the time-of-flight analyzer assembly can be housed in one or more vacuum chambers.

The ion source can be a continuous ion source.

The pulsing region can define a channel that extends along the axis and the pulsing region can include a first electrode extending along the axis, the first electrode defining one or more apertures, a second electrode extending along the axis, the first and second electrodes being positioned on opposing sides of the axis in a first direction perpendicular to the axis. The pulsing region can also include a third electrode extending along the axis and a fourth electrode extending along the axis, the third and fourth electrodes being positioned on opposing sides of a plane defined by the axis and the first direction. During operation of the system, the electronic controller can cause the pulsing region to operate in the first mode by applying a first set of voltages to the electrodes, and can cause the pulsing region to operate in the second mode by applying a second set of voltages to the electrodes. The system can further include one or more additional pairs of electrodes extending along the axis, each pair including an electrode on opposite sides of the plane. The first set of voltages can include RF voltages. The RF voltages applied to the first and second electrodes can be in phase with each other. The RF voltages applied to the third and fourth electrodes can be in phase with each other. The RF voltages applied to the first and second electrodes can be out of phase with the RF voltages applied to the third and fourth electrodes. The second set of voltages can include DC voltages that establish a potential gradient in the first direction.

The electronic controller can be programmed to sequentially apply the first set of voltages and then the second set of voltages to the electrodes.

In general, in another aspect, the invention features methods for analyzing ions using a time-of-flight mass analyzer. The methods include ionizing a sample to generate ions; directing the ions to a pulsing region of a time-of-flight mass analyzer; providing a first electric field within the pulsing region to guide the ions along an axis within the pulsing region; providing a second electric field within the pulsing region to accelerate the ions perpendicular to the axis out of the pulsing region; detecting the accelerated ions at a detector; and analyzing a mass of the ions based on a time-of-flight from the pulsing region to the detector.

Embodiments of the system may include one or more of the following features and/or features of other aspects. For example, the first electric field can be provided by applying a first set of voltages to electrodes disposed along the axis in the pulsing region. The first set of voltages can be RF voltages. A first RF voltage waveform can be applied to a first pair of the electrodes and a second RF voltage waveform out of phase with the first RF voltage waveform can be applied to a second pair of the electrodes.

The second electric field can be provided by applying a second set of voltages to the electrodes. The second set of voltages can be DC voltages. The DC voltages can cause the ions to exit the pulsing region through one or more apertures in one of the electrodes.

Applying the RF voltages can reduce oscillations of a potential at the axis relative to a mode of operation in which the RF voltages are not applied. Applying the RF voltages can reduce a kinetic energy distribution of the ions entering the pulsing region relative to a mode of operation in which the RF voltages are not applied. Symmetrically adjusting a magnitude of voltages can result in a non-zero potential on the axis. Applying the RF voltages can maintain the axis field-free and at a constant potential.

The details of one or more embodiments are set forth in the accompanying drawings and the description below. Other features and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
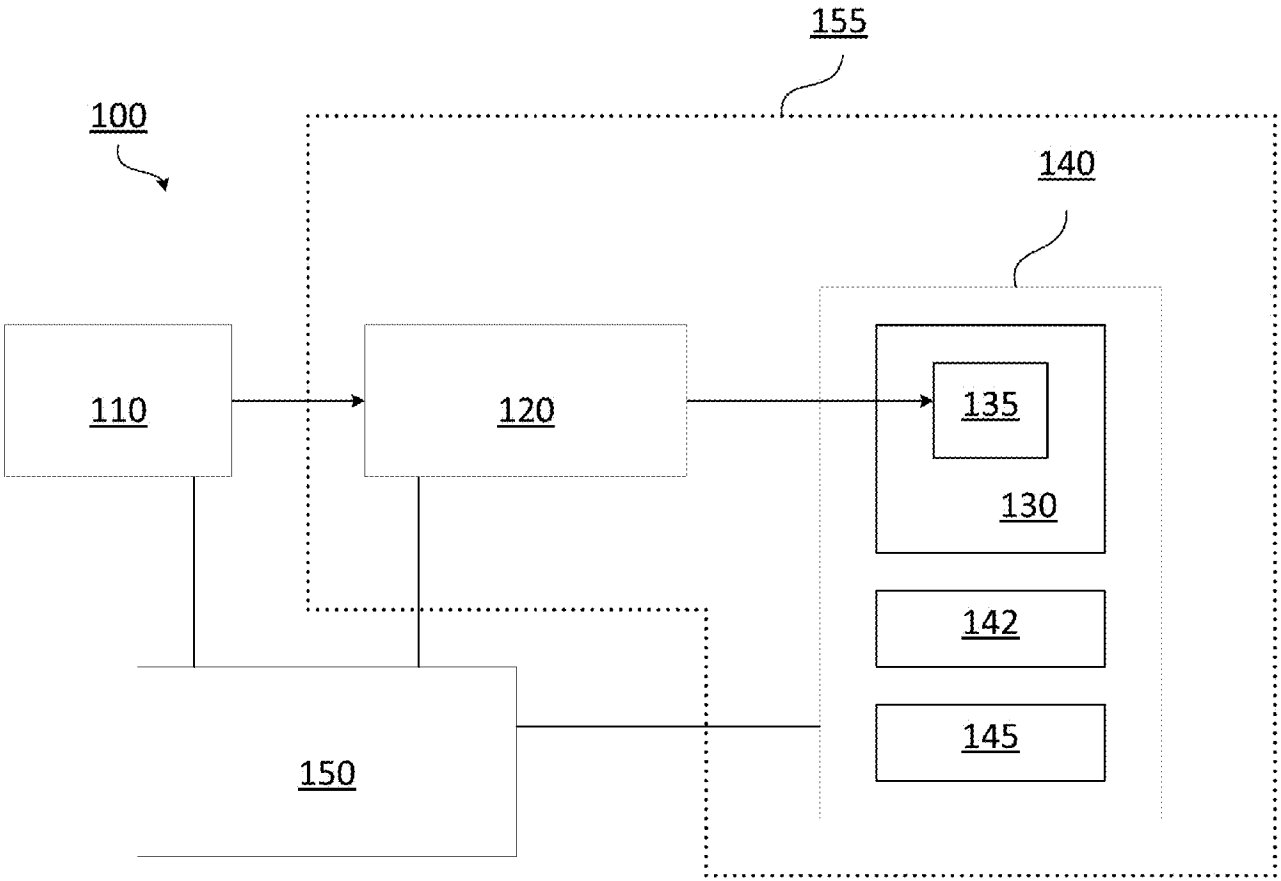
FIG. 1 is a schematic diagram showing an embodiment of a mass spectrometry system.

Referring to FIG. 1, an orthogonal acceleration time-of-flight (OA-TOF) mass spectrometer system 100 includes an ion source 110, which creates ions from a sample under analysis, an ion transport assembly 120 (which may include, e.g., one or more RF multipole ion guides, and/or quadrupole mass filters, and/or collision cells and/or electrostatic focusing lenses and/or apertures, and/or deflectors and/or capillaries, and/or skimmers, as is well-known in the art), an OA-TOF analyzer assembly 140, and an electronic controller 150. Ion transport assembly 120, and analyzer assembly 140 are housed in one or more vacuum chambers 155. Analyzer assembly 140 includes an orthogonal pulse-acceleration assembly 130, a field-free flight tube 142, optionally a reflectron mirror (not shown), and a detector 145. During operation of system 100, ion source 110 generates ions that are transported by ion transport assembly 120 in a primary ion beam along a primary ion beam axis to orthogonal acceleration assembly 130. Orthogonal acceleration assembly 130 includes a pulsing region 135, which receives ions in the primary ion beam from ion transport assembly 120, and periodically pulse-accelerates a segment of the ion beam orthogonally (orthogonal to the primary ion beam axis) towards the field-free flight tube 142 for time-of-flight mass-to-charge analysis of the ion population in the beam segment. Ions in the beam segment are pulse-accelerated to the same nominal kinetic energy and travel essentially the same nominal distance to the detector, so their flight times to the detector are proportional to the square root of their m/z values. Ions of a particular m/z value impinging on detector 145 at any point in time generate a detector signal proportional to their abundance. A mass-to-charge spectrum is obtained by recording the detector signal as a function of time. Typically, multiple such spectra are acquired and summed or averaged together to improve the signal-to-noise.

In general, a variety of ion sources can be used for ion source 110. Ion sources can be broadly classified into sources that provide ions at atmospheric pressure, so-called atmospheric pressure ion (API) sources and sources that provide ions at non-atmospheric pressures (e.g., reduced pressures). Examples of API sources include electrospray (ES) and atmospheric pressure chemical ionization sources (APCI), inductively coupled plasma (ICP), glow discharge (GD), thermospray (TS), and atmospheric pressure matrix assisted laser desorption ionization (MALDI) sources. Such API sources are housed outside vacuum chambers 155, as shown schematically in FIG. 1. Alternatively, non-atmospheric pressure ion sources typically operate in vacuum or partial vacuum, and would be housed within vacuum chambers 155 of FIG. 1 (not shown). Examples of non-atmospheric ion sources can be chemical ionization (CI), electron ionization (EI), fast atom bombardment (FAB), flow FAB, laser desorption (LD), MALDI, and particle beam (PB) ion sources.

In general, ion transport assembly 120 may include one or more ion guides arranged to transport ions between different locations within mass spectrometer system 100. In some embodiments, ion guides are also used to trap ions. Examples of ion guides can include multipole ion guides, which typically contain multiple parallel electrodes arranged symmetrically along an axis (e.g., quadrupole, hexapole and octapole ion guides, which features four, six, and eight electrodes or poles, respectively). Other types of RF ion guides, such as stacked-ring ion guide, or helical ion guides, as are well known in the art, may be used as well. Ion transport assembly 120 may include electrostatic lenses for focusing and/or steering ions in addition to, or instead of, RF ion guides.

An ion guide of ion transport assembly 120 can be housed in a single pressure region in the mass spectrometer 100 or it can extend continuously through multiple regions with different background pressures. In some embodiments, a single ion guide can extend continuously between two or more pressure regions. Some ion guides feature more than one segment. Each segment can have dedicated electronic controls that enable independent adjustments of AC (e.g., radio frequency (RF)) and/or DC electric fields supplied to each segment or assembly of the multipole ion guide. Through the application of appropriate electric fields, ion guides can perform m/z selection on ions that traverse through the guides. For example, m/z selection can be performed with a quadrupole through the application of appropriate RF frequency and DC voltages that allow only ions of a particular m/z or a range of m/z values to have stable trajectories within the quadrupole, while all other m/z values are unstable, as is well-known in the field; alternatively, RF and DC voltages can be applied to effect resonant frequency rejection of unwanted ions, ion m/z selection can be performed using AC and DC potentials with or without trapping of ions, or unwanted ion m/z values can be removed by scanning the RF amplitude or frequency of the electric field applied to the multipole ion guide.

Alternatively, or additionally, ion guides can be used to perform ion fragmentation. For example, DC voltages applied between different ion guides or ion guide segments can accelerate ions from one ion guide or ion guide segment into another ion guide or ion guide segment, leading to collisions between the accelerated ions and background gas molecules and/or gas molecules introduced for this purpose, in that ion guide or ion guide segment. These collisions result in the fragmentation of ions. Alternatively, additional AC voltages can be applied to an ion guide to achieve resonant frequency excitation fragmentation of selected m/z value ions in such higher gas density regions. Ion guides operated in relatively high gas pressures are also used to effect ion mobility separation of ions during their transport between an ion source and the OA-TOF mass analyzer.

While specific embodiments of orthogonal acceleration assemblies are described below, in general, the orthogonal acceleration assembly 130 includes a pulse-acceleration, or 'pulsing', region 135 defined by four or more electrodes, arranged in parallel about a primary beam axis. As primary beam ions pass into and through this pulsing region 135, RF voltages are applied to these electrodes so as to create radial RF fields similar to those created within conventional RF ion guides, which constrain the motion of the ions in radial directions, while allowing their free motion along the primary beam axis within the pulsing region 135 during this 'ion guide mode' of operation. At the appropriate time, the RF voltages applied to the electrodes of pulsing region 135 are abruptly changed to static DC voltages that establish an essentially homogeneous constant electric field within pulsing region 135, which pulse-accelerates a segment of the primary ion beam toward the TOF flight tube 142. Ions of different m/z values separate in time during their passage through the flight tube 142 to the detector 145, and the resulting detector output signal, registering ion impacts, is recorded as a function of time to produce a m/z spectrum.

After ions have left the orthogonal acceleration assembly 130 and enter the flight tube 142, the voltages applied to the electrodes of pulsing region 135 are abruptly changed to the previous RF voltages to allow subsequent ions to enter the pulsing region 135, and the cycle repeats. The RF ion guide mode allows the incoming ions to have very low axial kinetic energies (e.g., kinetic energies as low as 1 eV or less can be accommodated, as in conventional RF ion guides but energies of 3-10 eV are more typical) while being transported efficiently into and through the pulsing region, thereby enabling the TOF mass analyzer 140 to be configured with a significantly smaller footprint than with conventional OA-TOF instruments, and/or to be operated with lower-cost, lower voltage power supplies.

A variety of different detectors can be used for analyzer assembly 140. For example, detector 145 can be a channel electron multiplier array, that is, a 'channel plate', followed by an electron collector, or followed by a scintillator and photomultiplier; or a detector having a so-called conversion dynode operated at high ion acceleration voltage, to generate secondary electrons in response to the impact of an incoming ion or ions, where the electrons are directed to an electron multiplier for amplification; any of which generates a signal proportional to the number of ions that impinge on the surface of the detector.

Signals from the detector are recorded with a data acquisition system, included generally within electronic control system 150. Control system 150 is also in communication with ion source 110, ion transport assembly 120, and OA-TOF analyzer assembly 140, coordinating data acquisition and analysis with the operation of the various components of system 100. Accordingly, control system 150 can include power supplies and electrical connections for applying voltages (e.g., AC and/or DC) to ion transport assembly 120 and OA-TOF analyzer assembly 140, including RF and pulse-DC voltages applied to the pulse region 135 electrodes, in addition to electronic processors such as timers and data analyzers and input (e.g., keyboards or keypads) and output devices (e.g., one or more displays) that facilitate operation of the system.

In the description that follows, charged particles generated by ion source 110 are assumed to be positive ions, nonetheless it should be understood that the systems disclosed herein work just as well for negative ions or electrons, in which cases the voltages applied to the various electrodes of the system 100 would be of the opposite polarities from those described below.

Figure 2:
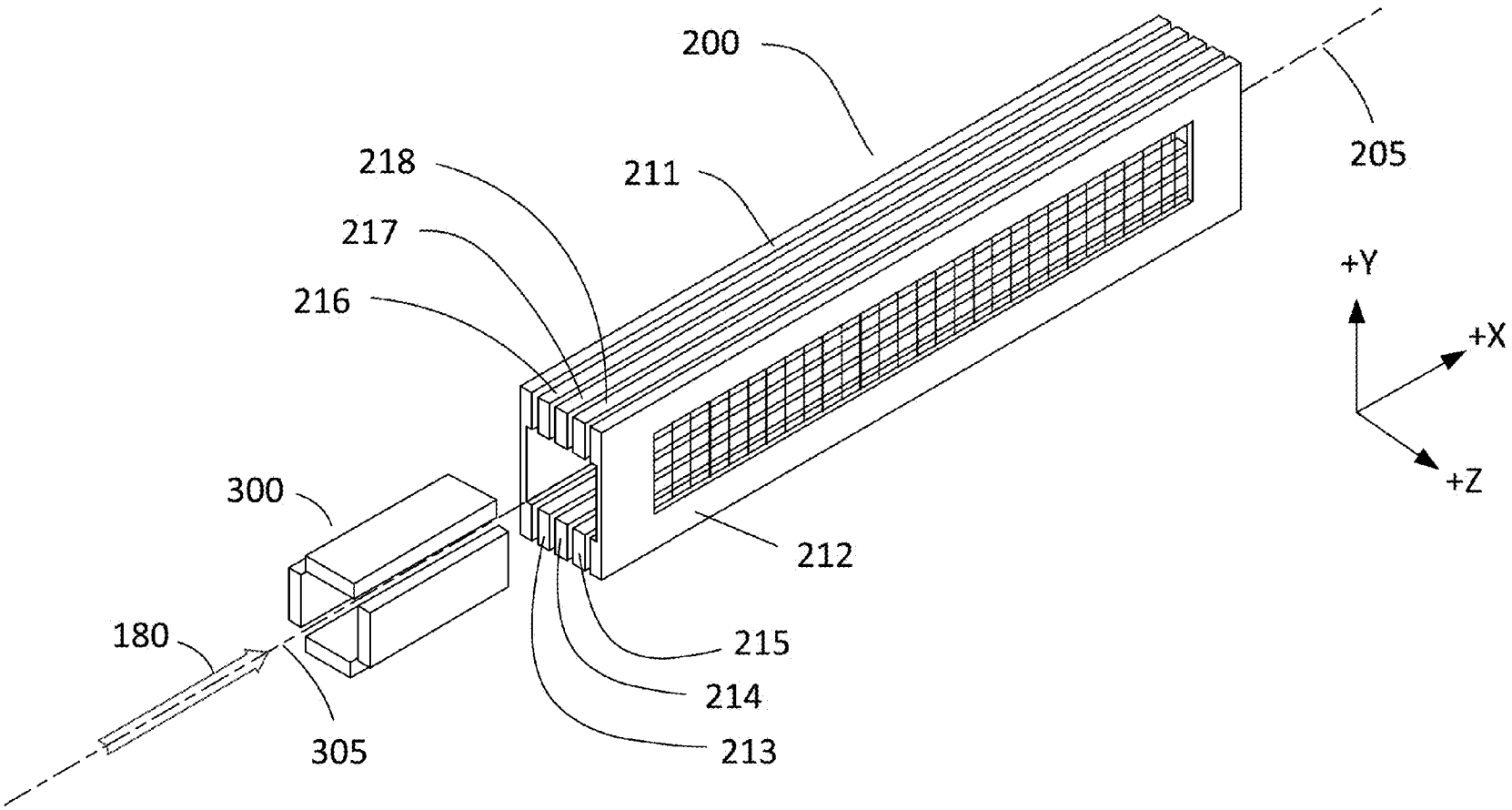
FIG. 2 is a perspective view of an embodiment of a pulsing region of a mass spectrometry system.

Turning now to specific examples of orthogonal acceleration assemblies, FIG. 2 shows, in perspective view, a specific embodiment 200 of pulsing region 135 of FIG. 1, together with a portion of an RF ion guide 300 incorporated in this embodiment as a component of ion transport system 120 of FIG. 1. Ion guide 300 is shown in FIG. 2 as a square quadrupole ion guide, but a hexapole ion guide, or, or any other type of RF ion guide, would function as well, as is well known. An electrostatic lens assembly could be used as well instead of, or in addition to, to direct/focus ions. Ion guide 300 has a central axis 305 along which the primary ion beam 180 is guided, and is positioned adjacent to orthogonal acceleration assembly 200. Orthogonal acceleration assembly 200 includes a number of electrodes extending along an axis 205, such that the orthogonal acceleration assembly 200 central axis 205 is coincident with ion guide axis 305. Orthogonal acceleration assembly 200 includes a pusher electrode 211, a puller electrode 212, and six intermediate electrodes 213, 214, 215, 216, 217 and 218 respectively. Pusher electrode 211 and puller electrode 212 are flat electrodes that are parallel to each other. In this figure, the x-axis is taken to be the primary beam axis, the TOF acceleration direction is taken to be the z-axis.

Figure 3:
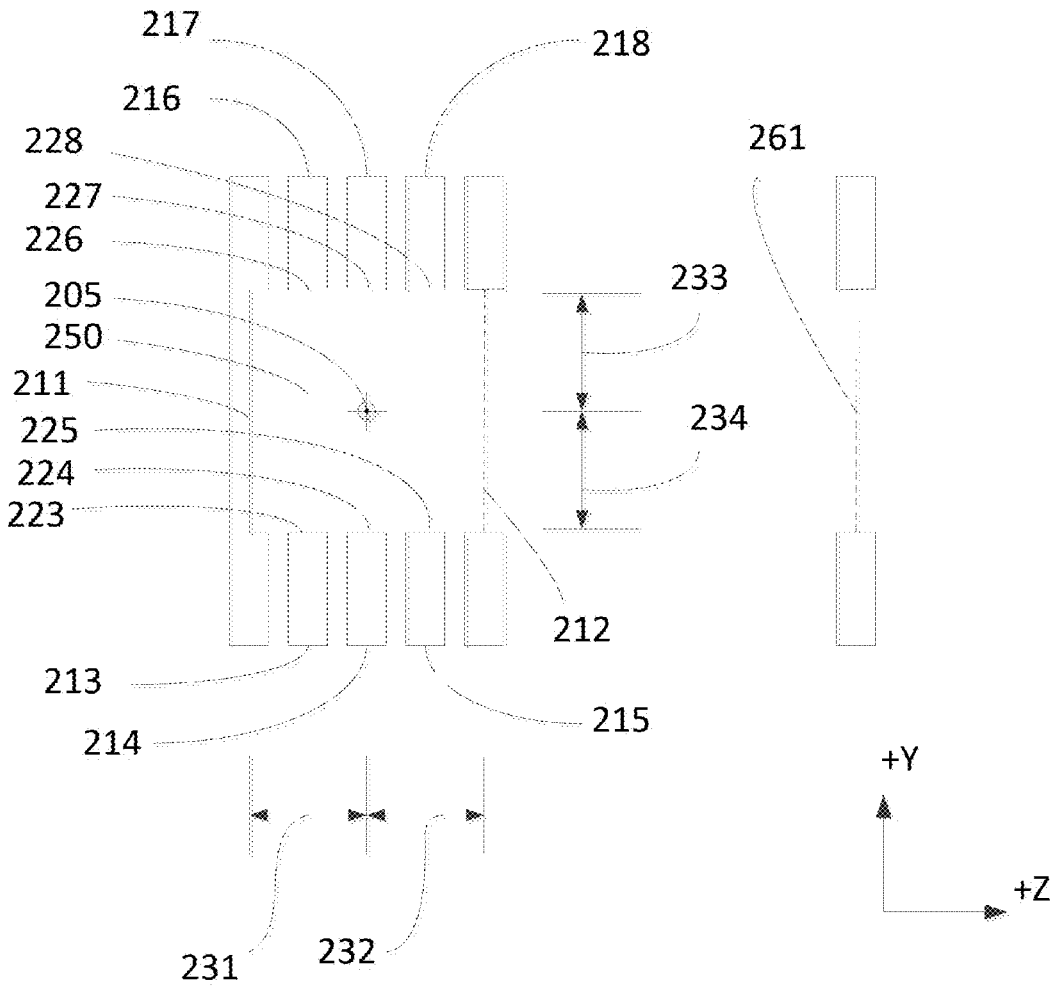
FIG. 3 is a cross-sectional view of an embodiment of a pulsing region of a mass spectrometry system.

As shown more clearly in the cross-section view of pulsing assembly 200 in FIG. 3, the pusher electrode 211 is spaced apart from the axis 205 by a distance 231 in the negative z-axis direction, while puller electrode 212 is spaced apart from the axis 205 by a distance 232 in the positive z-axis direction, where distances 231 and 232 are generally equal in magnitude. At least a portion of puller electrode plate 212 is composed of a flat grid (or, alternatively, a slot elongated in the primary beam direction and centered on the y-axis) through which ions are able to pass with good efficiency from the pulse acceleration region 250 between pusher electrode 211 and puller electrode 212 on their way toward TOF flight tube entrance grid 261. Intermediate electrodes 213, 214 and 215 are also flat electrodes oriented parallel to and between pusher electrode 211 and puller electrode 212, such that their faces 223, 224 and 225 are arranged coincident with a virtual flat surface that is orthogonal to the faces of pusher electrode 211 and puller electrode 212, parallel to axis 205, and spaced apart from axis 205 by the distance 233 along the positive y-axis direction. Similarly, intermediate electrodes 216, 217 and 218 are also flat electrodes oriented parallel to and between pusher electrode 211 and puller electrode 212, such that their faces 226, 227 and 228 are arranged coincident with a virtual flat surface that is orthogonal to the faces of pusher electrode 211 and puller electrode 212, parallel to axis 205, and spaced apart from axis 205 by the distance 234 along the negative y-axis direction. Generally, the distances 231 and 232 will be of the same magnitude, as will distances 233 and 234, which, however do not necessarily have to be the same magnitude as the distances 231 and 232.

Also, generally, intermediate electrodes 213 and 216 are electrically connected, intermediate electrodes 214 and 217 are electrically connected, and intermediate electrodes 215 and 218 are electrically connected. As such, each of these electrode pairs may be fabricated either as a single electrode, or as separate electrodes connected by circuitry. Hence, electrodes 213 and 216 will be referred to as intermediate electrode 213/216, electrodes 214 and 217 will be referred to as intermediate electrode 214/217, and electrodes 215 and 218 will be referred to as intermediate electrode 215/218.

Figure 4:
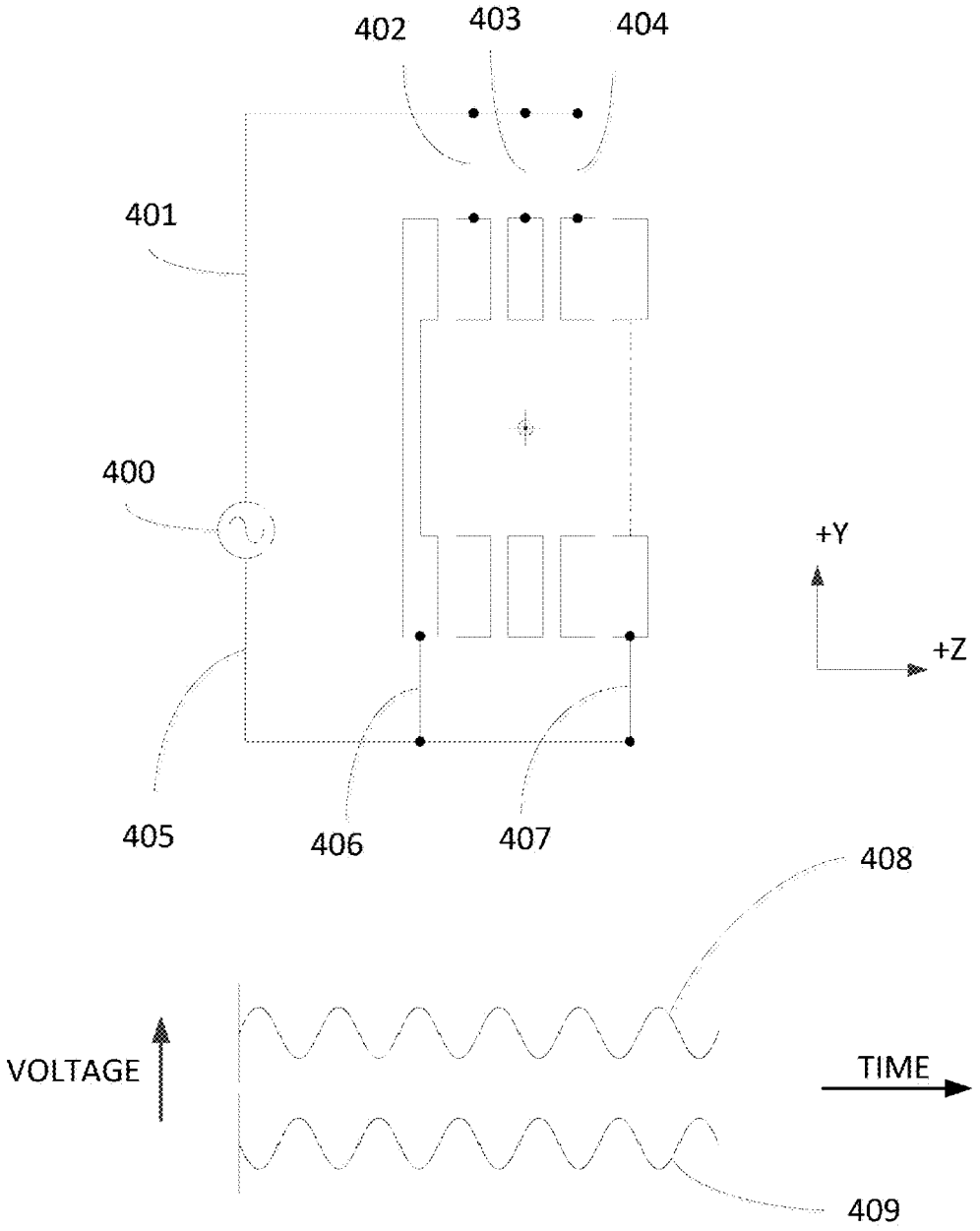
FIG. 4 is a cross-sectional view of an embodiment of the pulsing region shown in FIG. 3, along with exemplary traces of RF signals applied to electrodes in the pulsing region.

During ion passage into and through pulse acceleration region 250 along axis 205, orthogonal acceleration assembly 200 is operated in a mode of operation similar to that of an RF ion guide. In this ion guide mode RF voltages of essentially the same amplitude, phase, and frequency are applied to each intermediate electrode 213/216, 214/217, and 215/218. Similarly, RF voltages of the same frequency as, but with phases opposite from (essentially 180 degrees different from) the RF voltages applied to the intermediate electrodes are also applied to the pusher electrode 211, and to the puller electrode 212. FIG. 4 illustrates schematically the functional arrangement of connections between the electrodes 213/216, 214/217, 215/218, 211 and 212 of FIG. 3, and the source of the RF voltages 400, during the period of ion filling/ion guide mode. One phase of the RF voltage waveform, shown as 408 in FIG. 4, is applied to the intermediate electrodes 213/216, 214/217, and 215/218 via electrical connections 401, 402, 403, and 404, while the opposite phase of the RF waveform, shown in FIG. 4 as 409, is applied to pusher electrode 211 and puller electrode 212 via electrical connections 405, 406, and 407. The waveform of the RF voltages may be sinusoidal, or square-wave, or essentially any other waveform as is known in the art of RF ion guides.

While, ideally, the amplitudes of the RF voltages applied to the pusher electrode 211 and puller electrode 212 will be the same, in some embodiments, they may be adjusted to slightly different amplitudes from each other, and/or from the RF voltage amplitudes applied to the intermediate electrodes 213/216, 214/217 and 215/218, in order to compensate for any geometric asymmetry in the assembly 200, and ensure that the axis 205 remains essentially field-free and at a constant potential.

Figure 5:
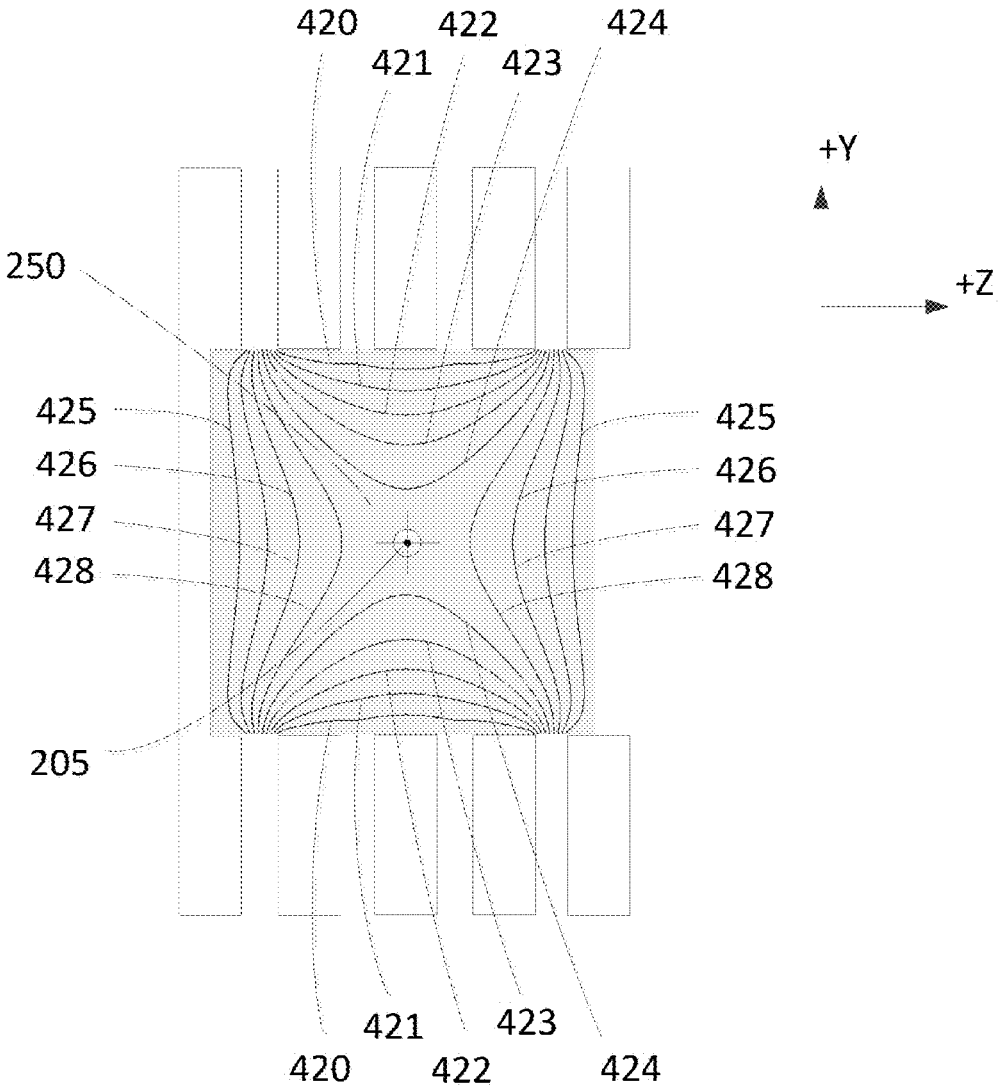
FIG. 5 is a cross-sectional view of an embodiment of a pulsing region showing equipotential contours at one time point in the RF waveform while the pulsing region is operated in a guiding mode.

Such asymmetries may arise, for example, from the difference in electrode geometry between the continuous face and contours of the pusher electrode 211 and the puller electrode 212, and the potential surface created by the combination of intermediate electrodes 213/216, 214/217 and 215/218. To illustrate this, consider for example, an embodiment in which the dimensions 231, 232, 233 and 234 of FIG. 3 are all equal to 4.4 mm; the lengths of the individual intermediate electrode faces 223, 224, 225, 226, 227, and 228 along the z-direction are all 1.4 mm; and each gap between any two adjacent electrodes is 0.80 mm in the z-direction. The potential distribution within the pulsing region 250 was calculated for this geometry, with equal and opposite polarity voltages applied to the electrodes 211 and 212, and to the electrodes 213/216, 214/217 and 215/218, respectively. Nine of the corresponding equipotential contours are plotted in FIG. 5, representing equal increments in potential between the voltage applied to the electrodes 211 and 212, and the equal and opposite polarity voltage applied to the orthogonal electrodes 213/216, 214/217 and 215/218. That is, if the voltage applied to the pusher electrode 211 and the puller electrode 212 was +RFV, and the voltage applied to the intermediate electrodes 213/216, 214/217 and 215/218 was −RFV, then equipotential contour 420 is that of −0.8 RFV; the equipotential contour 421 is that of −0.6 RFV; the equipotential contour 422 is that of −0.4 RFV; the equipotential contour 423 is that of −0.2 RFV; the equipotential contour 424 is that of 0 volts; the equipotential contour 428 is that of 0.2 RFV; the equipotential contour 427 is that of 0.4 RFV; the equipotential contour 426 is that of 0.6 RFV; and the equipotential contour 425 is that of 0.8 RFV.

An ideal geometry produces equipotential contours that are symmetric between the Z and Y directions, with the potential on the central axis 205 being precisely the average of the voltages applied to the electrodes, that is, zero volts with the equal but opposite voltages applied to the electrodes as in the preceding example. However, it is apparent from the plot of equipotentials of FIG. 5 that the potential distribution for the geometry of FIG. 5 does not exhibit such symmetry. For example, the equipotential contour 424 for zero volts does not pass through the center axis 205; the potential at the axis 205 was determined to be about 4% of the voltage applied to the pusher electrode 211 and puller electrode 212. This means that, as the RF voltage oscillates, the potential on the axis will oscillate, in phase, with a peak amplitude about 4% of the peak RF amplitude applied to the electrodes. While an oscillation of potential on the axis 205 would have little consequence for ions already within the pulsing region 250, such an oscillation is expected to broaden the kinetic energy distribution of the primary beam ions as the ions transition from the upstream transport optics into the pulsing region 250.

Figure 6:
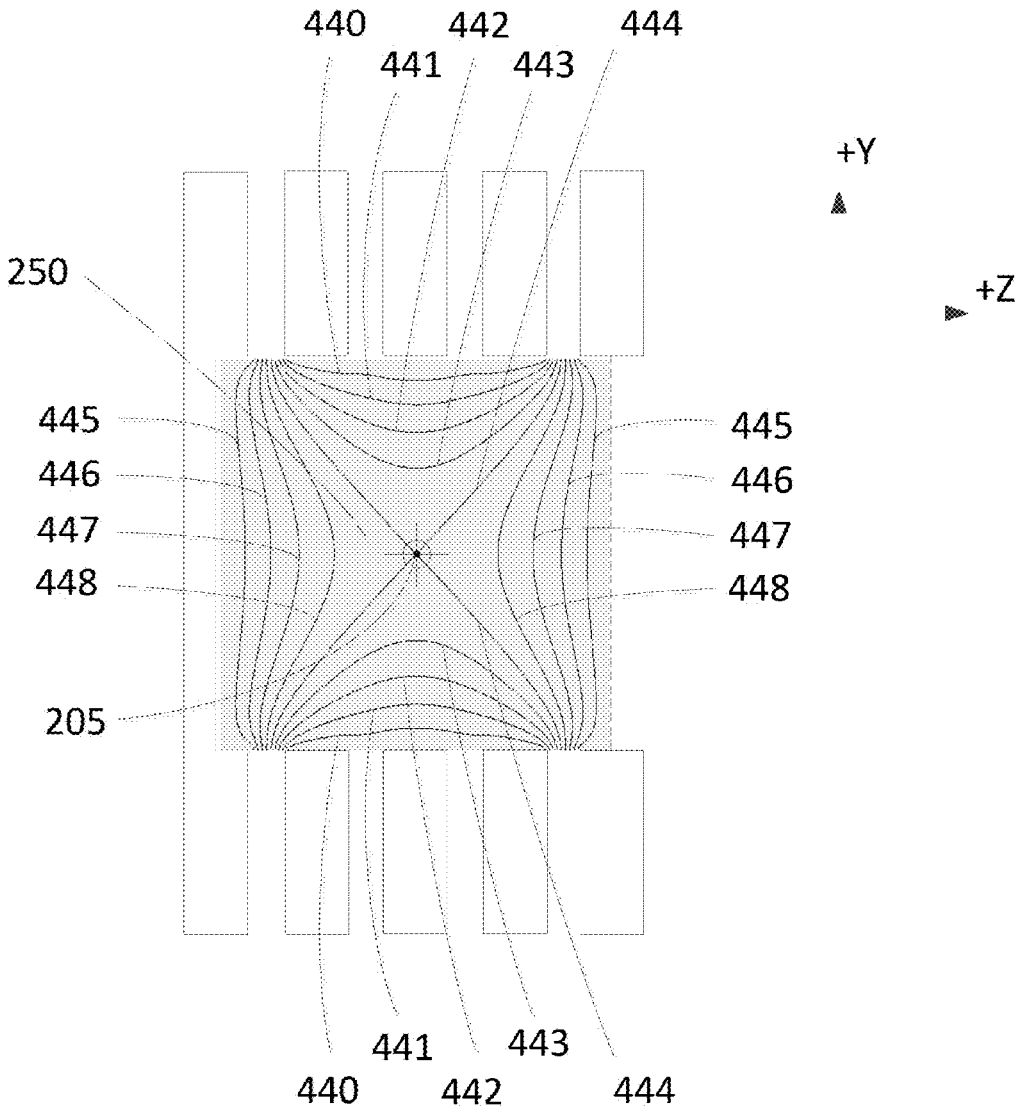
FIG. 6 is a cross-sectional view of another embodiment of a pulsing region showing equipotential contours at one time point in the RF waveform while the pulsing region is operated in a guiding mode.

Such kinetic energy broadening with the embodiment of FIG. 5 may be tolerable in some situations, but not in others. In some embodiments, one may adjust the RF voltage amplitude applied to the pusher electrode 211 and puller electrode 212 to be slightly less than that applied to the intermediate electrodes 213/216, 214/217 and 215/218. Other solutions may involve modifications of the detailed geometry of the pulsing assembly that compensate for this asymmetry. For example, in some embodiments, one may compensate for the differences in geometry between the two RF 'poles' during the pulsing region ion guide mode, in which the pulsing assembly 200 is configured such that distances 233 and 234 are different from the distances 231 and 232, resulting in a rectangular profile for the pulsing region boundary. For example, in order to eliminate any oscillation of the potential at the central axis 205 as the RF voltage oscillates, the particular arrangement of electrodes presented in FIG. 5 should have dimensions 233 and 234 be about 0.94 of the dimensions 231 and 232. That is, with the specific geometry of FIG. 5, it was found that reducing the dimensions 233 and 234 to 4.131 mm while the dimensions 231 and 232 were maintained at 4.4 mm, resulted in essentially zero volts at the central axis 205 when the voltage applied to the pusher electrode 211 and puller electrode 212, was equal and opposite polarity to the voltage applied to the intermediate electrodes 213/216, 214/217 and 215/218. This geometry is illustrated in FIG. 6, where the same voltages and calculated potential contours as was displayed in FIG. 5 are presented. That is, the equipotential contours 420-428 of FIG. 5 have the same potential values as equipotential contours 440-448 of FIG. 6, respectively. The improvement in the symmetry between the potential contours in the y and z axes is evident. In particular, the potential contours 444 corresponding to zero volts potential now pass through the central axis 205, indicating that the potential on this axis 205 remains essentially constant as the RF voltages on the surrounding electrodes oscillate. Other modifications to the geometrical details of the pulsing assembly 200 that also can compensate for the asymmetry will be apparent to the skilled person.

In the RF ion guide mode, assembly 200 allows the efficient passage of low energy ions along the axis 205. Such ions remain close to the axis 205 provided that no electric fields other than the ion guide RF fields are present. However, the puller electrode 212 is configured with a slit or grid or other aperture arrangement in order to allow passage of the ions to the TOF flight tube when the operating mode is switched to the TOF pulse acceleration mode. Typically, however, the region between the puller electrode 212 and the TOF flight tube entrance will maintain a constant acceleration field comprising a second acceleration stage that further accelerates ions that are pulse accelerated through the puller electrode apertures during the DC pulse acceleration mode. Unfortunately, such a second acceleration field will have some contribution to the electric fields within the pulsing region 250 due to 'leakage' of the second acceleration field through the aperture arrangement of puller electrode 212. Such 'leakage' will often cause a deflection of the low energy ions from the axis 205 within the pulsing region 250 during the RF ion guide operating mode, and therefore degrades performance. Such field 'leakage' can be reduced by reducing the opening sizes of the apertures, but this has the detrimental effect of reducing ion transmission as well. Alternatively, it has been determined that such field 'leakage' can be made negligible by adding a second layer of puller electrode 212 apertures, such as a second grid, connected electrically to the puller electrode 212, and spaced apart from the puller electrode 212 by a short distance, for example, by 0.5-3 mm. This arrangement results in much less loss of ion transmission for the same field 'leakage' reduction. As another option, it has been found that such field penetration through the puller electrode 212 can be reduced or eliminated by adjusting the DC offset voltage that references the RF voltage applied to the puller electrode 212, to values different than that applied to the other pulsing region intermediate electrodes, thereby counteracting such field penetration through the puller electrode. Further, it has been found that the most effective arrangement for eliminating field penetration through the puller electrode 212 is to provide the ability to independently adjust all the DC offset voltages of the RF voltages applied to each of electrodes 211, 212, 213/216, 214/217, and 215/218, and thereby maintain the axis 205 essentially field-free and at an essentially constant potential. This was achieved by providing separate RF power supplies for each of these electrodes, which all operate with the same RF voltage amplitude and relative phase, but which are each referenced to an independently controlled DC offset voltage.

In order to perform a TOF m/z measurement, the operating mode of the pulse acceleration assembly 200 should switch abruptly from the RF ion guide mode to the TOF pulse acceleration mode. This is accomplished by abruptly (e.g., within a timespan of about 200 nanoseconds, or, even more preferably, as close to instantaneous as the drive electronics will allow, such as about 20 ns, about 50 ns, or about 100 ns) switching the voltages applied to the electrodes 211, 212, 213/216, 214/217 and 215/218 from the RF voltages employed for the RF ion guide mode, to constant DC voltages necessary to generate a uniform, constant acceleration field in the pulsing region 250, such that ions within the pulsing region 250 are accelerated in the +Z direction toward the TOF flight tube 142 entrance grid 261, and ultimately properly time-focused at the TOF detector 145. Alternatively, in some embodiments, a controllable time delay may be introduced between the abrupt removal of the RF voltages, and the application of the constant DC voltages that establish the constant, uniform DC acceleration field. This approach, sometimes referred to as "delayed extraction" focusing, has been shown to improve TOF resolving power by taking advantage of the increasing correlation between the initial ion positions and their initial velocities in the pulsing region at the time that the pulse acceleration occurs.

At the time that the TOF pulse acceleration occurs, the primary beam ions 180 of FIG. 2 that had been guided into and through the pulsing region 250, will exhibit a distribution of spatial positions and velocity components along the Z-axis. One of the primary functions of the pulsing acceleration assembly 130 is to optimize the time-focusing of the primary beam ions at the TOF detector 145, given that the initial positions and velocities of the primary beam ions vary over finite ranges. A commonly used arrangement of pulse acceleration optics, originally developed by Wiley and McLauren in 1955 to achieve good time focusing at the TOF detector for a finite initial spatial spread of ions, entails 2 stages of acceleration, both stages generating a uniform constant electric field, but with a different, optimized field strength in each stage. The pulse acceleration optics assemblies 200 of FIGS. 2 through 6 are therefore configured so as to provide such a constant, uniform acceleration field. This is accomplished by providing a different pulse voltage to each of the electrodes 211, 212, 213/216, 214/217 and 215/218, depending on the position of each electrode in the TOF Z-direction. In other words, pulse voltages are applied to the pusher electrode 211 and the puller electrode 212 which establish the linear potential gradient between these electrodes. The DC pulse voltage amplitudes applied simultaneously to the intermediate electrodes 213/216, 214/217 and 215/218, then, are established for each of these separately to be between the pusher and puller voltages, and proportional to their distance in the Z-direction between the pusher and puller voltages. For example, for the geometries of FIGS. 2-6, given a pulse voltage amplitude of +Vp applied to the pusher electrode 211, and a pulse voltage amplitude of −Vp applied to the puller electrode 212, then a uniform, constant field is established in the pulsing region 250 when the pulse voltage amplitudes of 1/2 Vp, 0, and −1/2 Vp are applied simultaneously to the intermediate electrodes 213/216, 214/217 and 215/218, respectively. For the geometry of FIG. 6, nine potential contours calculated for such a set of pulse voltages is displayed in FIG. 7. The potential contour 450 is for the potential of 0.8 Vp; the potential contour 451 is for the potential 0.6 Vp; the potential contour 452 is for the potential 0.4 Vp; the potential contour 453 is for the potential 0.2 Vp; the potential contour 454 is for the potential 0 volts; the potential contour 455 is for the potential −0.2 Vp; the potential contour 456 is for the potential −0.4 Vp; the potential contour 457 is for the potential −0.6 Vp; the potential contour 458 is for the potential −0.8 Vp.

Figure 7:
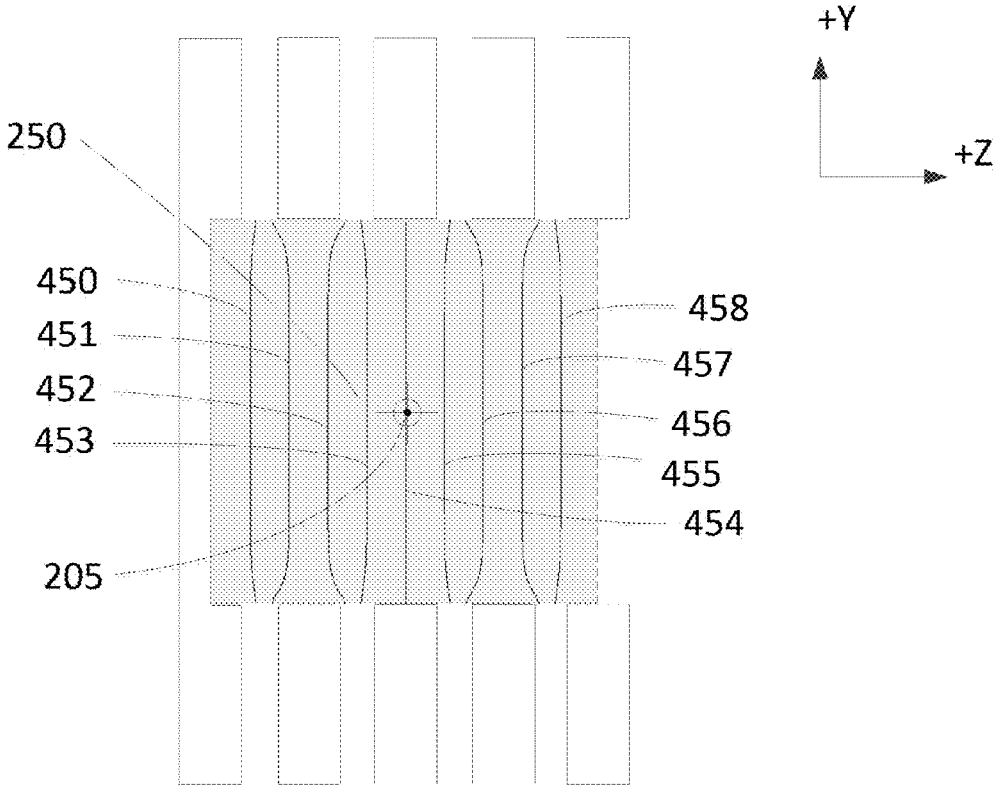
FIG. 7 is a cross-sectional view of an embodiment of a pulsing region showing equipotential contours while the pulsing region is operated in an orthogonal acceleration mode.

The equipotential contours are each essentially planar and equally-spaced within the central portion of the assembly 200, as illustrated in FIG. 7. Quantitatively, it was found that the electric field during this pulse acceleration period differs from the ideal constant, uniform electric field between the pusher electrode 211 and the puller electrode 212 by substantially less than 0.1% over the entire central 3 mm diameter centered on axis 205, for the exemplary geometry of FIG. 7, which has dimensions specified previously with reference to FIG. 3.

Figure 8:
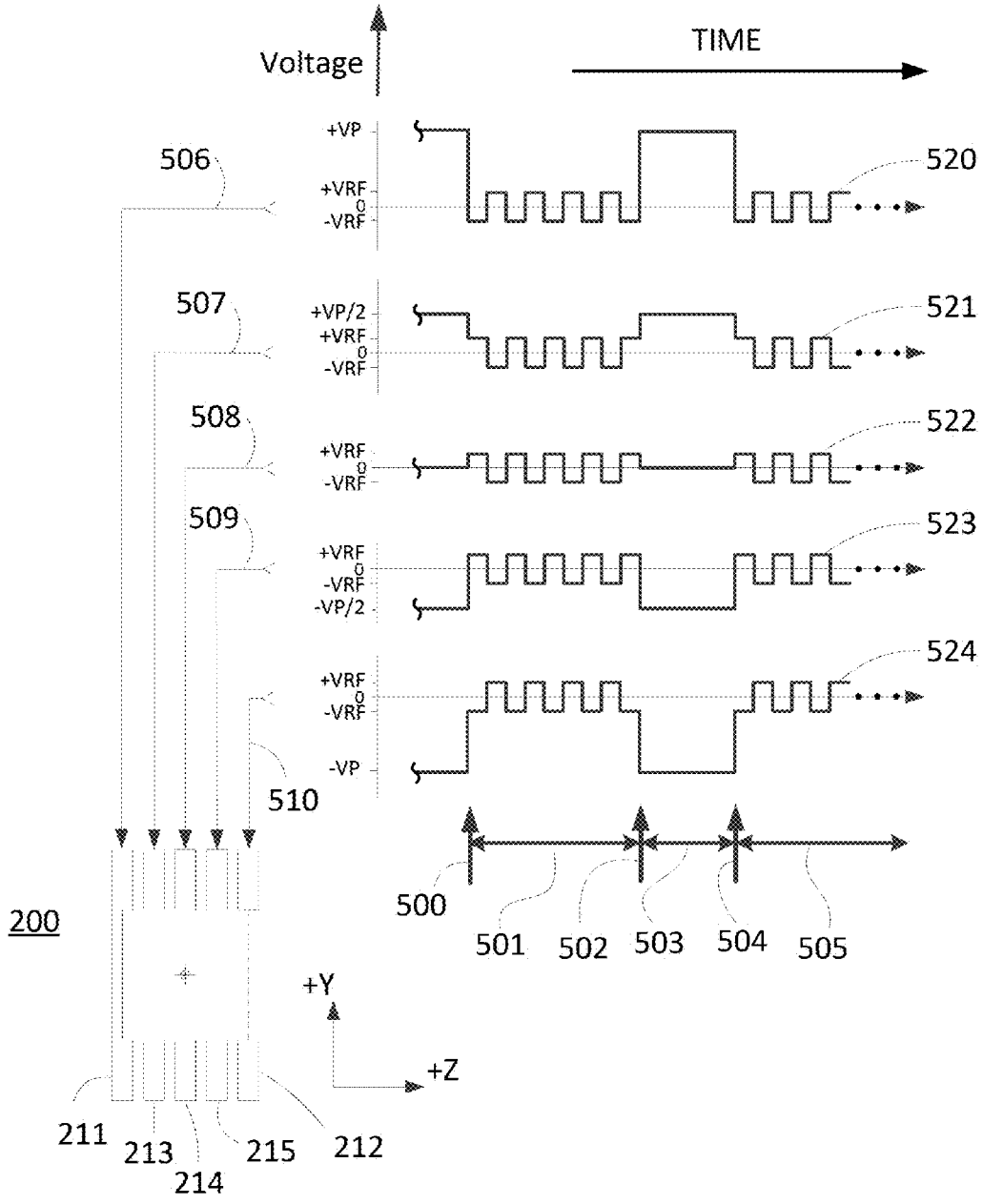
FIG. 8 is a schematic showing voltage traces applied to different electrodes in a pulsing region that operates in guiding mode and orthogonal acceleration mode.

Different voltages are used for each electrode 211, 212, 213/216, 214/217 and 215/218 of the embodiment shown in FIG. 2, between the RF ion guide, ion entry mode, and the TOF pulse acceleration mode. FIG. 8 illustrates how the voltage levels applied to the electrodes 211, 212, 213/216, 214/217 and 215/218, respectively, of TOF pulsing assembly 200, vary over time where the RF voltage waveform is provided as a square wave. In FIG. 8, voltage waveform 520 is applied to the pusher electrode 211 via electrical connection 506; voltage waveform 521 is applied to intermediate electrode 213/216 via electrical connection 507; voltage waveform 522 is applied to intermediate electrode 214/217 via electrical connection 508; voltage waveform 523 is applied to intermediate electrode 215/218 via electrical connection 509; and, voltage waveform 524 is applied to puller electrode 212 via electrical connection 510. Not shown here is that voltage waveform 524 may also include a DC offset voltage, that is different from those optionally incorporated into waveforms 520-523, which counteracts any field penetration through the openings of electrode 212, as described above. During the exemplary time period 501 of the RF ion guide mode, the RF voltages applied to the pusher electrode 211 and puller electrode 212 at any point in time are essentially the same, and the RF voltages applied to the intermediate electrodes 213/216, 214/217 and 215/218 are also essentially the same at any point in time, but of opposite polarity to the RF voltages applied to the pusher and puller electrodes 211 and 212, respectively. Some means of synchronization is provided to ensure the proper phase relation between these RF voltages, as is well known in the art. While the RF waveform is shown in FIG. 8 to be a square wave, any other waveform, such as sinusoidal, could be used as well. The RF ion guide mode operates during the ion 'filling' period, such as time period 501, from the end of one TOF pulse acceleration period, such as time point 500, until the beginning of the next TOF pulse acceleration period, such as time point 502.

Figure 9:
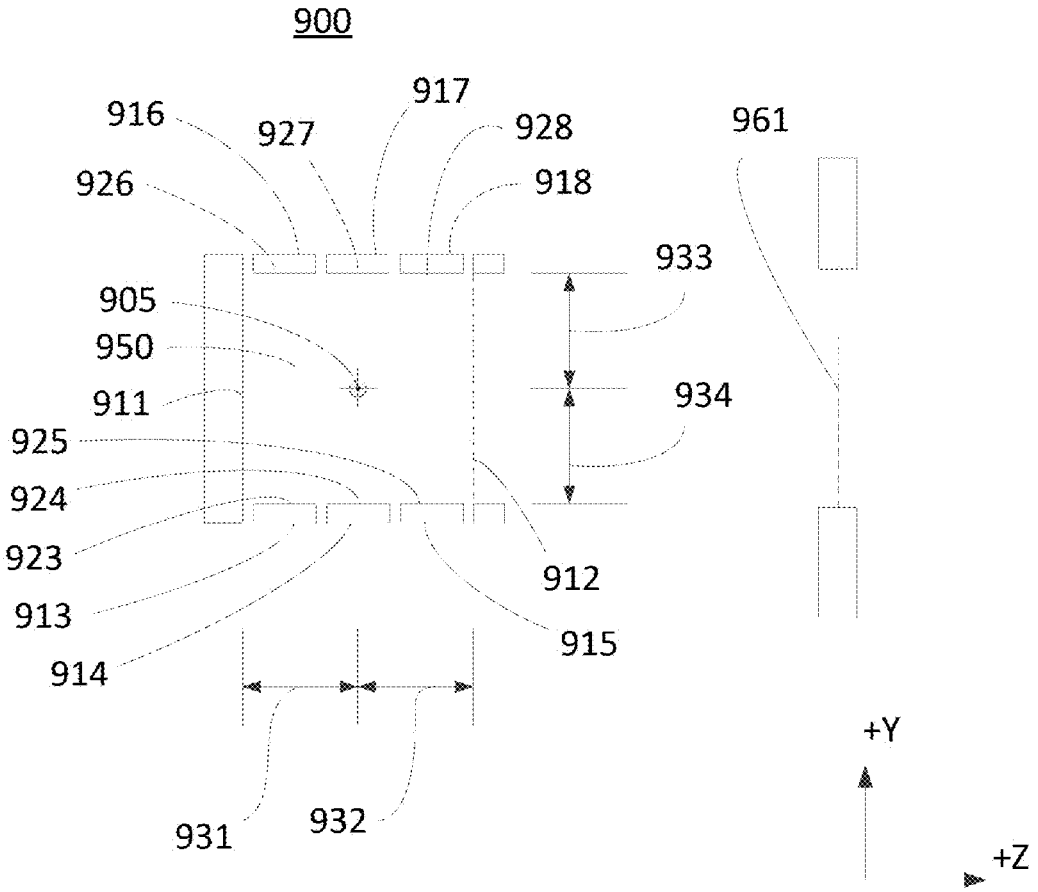
FIG. 9 is a cross-sectional view of an embodiment of a pulsing region of a mass spectrometry system.

Exemplary time point 502 marks the transition point between the end of one RF ion guide mode period and the beginning of TOF pulse acceleration period 503. For this particular electrode geometry, during this TOF pulse acceleration period 503, the voltage 520 applied to the pusher electrode 211 is Vp; the voltage 521 applied to the intermediate electrode 213/216 is Vp/2; the voltage 522 applied to the intermediate electrode 214/217 is 0; the voltage 523 applied to the intermediate electrode 215/218 is −Vp/2; the voltage 524 applied to the puller electrode 212 is −Vp. These voltages produce the linear, homogeneous electric field shown in FIG. 7. At the end of the TOF pulse acceleration period 503, the voltages applied to the various electrodes switch back to the RF ion guide mode during the subsequent ion filling period 505, and the cycle repeats. It will be well understood to those skilled in the art that many geometrical and electrical variations are possible that provide the same or similar RF and DC electric fields within the pulsing region as the embodiment(s) described so far. For example, the cross-section of another preferred embodiment is illustrated in FIG. 9. The cross section of the embodiment shown in FIG. 9, assembly 900, is configured as a square-shaped pulsing region, as was that of FIG. 3. However, the assembly 900 geometry differs from that of FIG. 3 in that: 1) the pusher electrode 911 and the puller electrode 912 have no 'step' in their cross-sectional profile at the corners of the square pulsing region 950; 2) the widths of the intermediate electrodes 913/916, 914/917, and 915/918 are increased so as to minimize the gaps between them in the Z-direction as much as is practical with respect to voltage arcing, and manufacturing difficulty; and 3) the external dimensions of the intermediate electrodes 913/916, 914/917, and 915/918 are reduced so as to minimize their thickness of these electrodes in the Y-direction. Hence, these electrodes may be manufactured as thin or thick film traces supported by a planar insulator, for example.

The combination of the intermediate electrode surfaces 923, 924 and 925, and 926, 927 and 928, come closer to continuous planar boundaries, respectively, of pulsing region 950 in the Y-direction than did the corresponding surfaces of FIG. 3. Therefore, the application of an RF voltage waveform of a given amplitude to the intermediate electrodes 913/916, 914/917, and 915/918, and the application to pusher and puller electrodes, 911 and 912, respectively, of the same waveform (except for a 180 degrees phase difference), will produce much less oscillation of the potential on the axis 905 than with the geometry of FIG. 3.

Figure 10:
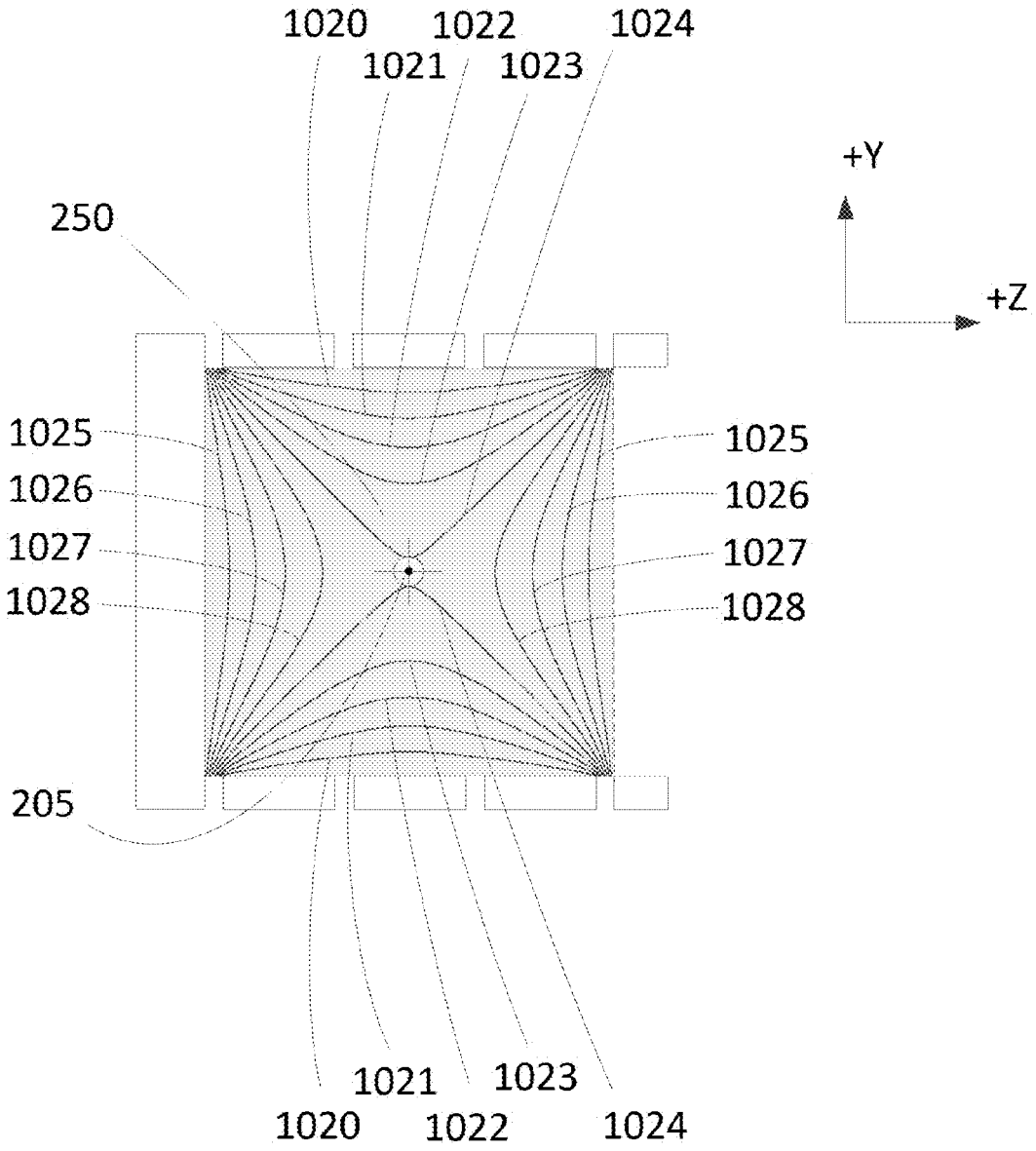
FIG. 10 is a cross-sectional view of another embodiment of a pulsing region showing equipotential contours at one time point in the RF waveform while the pulsing region is operated in a guiding mode.

The potential distribution within the pulsing region 950 was calculated for the assembly 900 geometry of FIG. 9, with equal and opposite polarity voltages applied to the electrodes 911 and 912, and to the electrodes 913/916, 914/917 and 915/918, respectively. Nine of the corresponding equipotential contours are plotted in FIG. 10, representing equal increments in potential between the voltage applied to the electrodes 911 and 912, and the equal and opposite polarity voltage applied to the orthogonal electrodes 913/916, 914/917 and 915/918. That is, if the voltage applied to the pusher electrode 911 and the puller electrode 912 was +RFV, and the voltage applied to the intermediate electrodes 913/916, 914/917 and 915/918 was −RFV, then equipotential contour 1020 is that of −0.8 RFV; the equipotential contour 1021 is that of −0.6 RFV; the equipotential contour 1022 is that of −0.4 RFV; the equipotential contour 1023 is that of −0.2 RFV; the equipotential contour 1024 is that of 0 volts; the equipotential contour 1028 is that of 0.2 RFV; the equipotential contour 1027 is that of 0.4 RFV; the equipotential contour 1026 is that of 0.6 RFV; and the equipotential contour 1025 is that of 0.8 RFV.

While it is apparent from the plot of equipotentials of FIG. 10 that the potential distribution for the assembly geometry of FIG. 9 does not exhibit perfect symmetry, as would be the case for the ideal geometry, nevertheless, the potential at the axis 905 was determined to be only about 0.5% of the voltage applied to the pusher electrode 911 and puller electrode 912, which is an improvement of a factor of 7 over the geometry of FIG. 3. Hence, for this structure, an RF waveform with a 100 v peak amplitude results in about 1 eV p-p kinetic energy spread in the ion population in the pulsing region. This energy spread should be tolerable. If not, then a small deviation from the square cross section profile can also be incorporated, similar to the approach taken for the geometry of FIG. 6.

Figure 11:
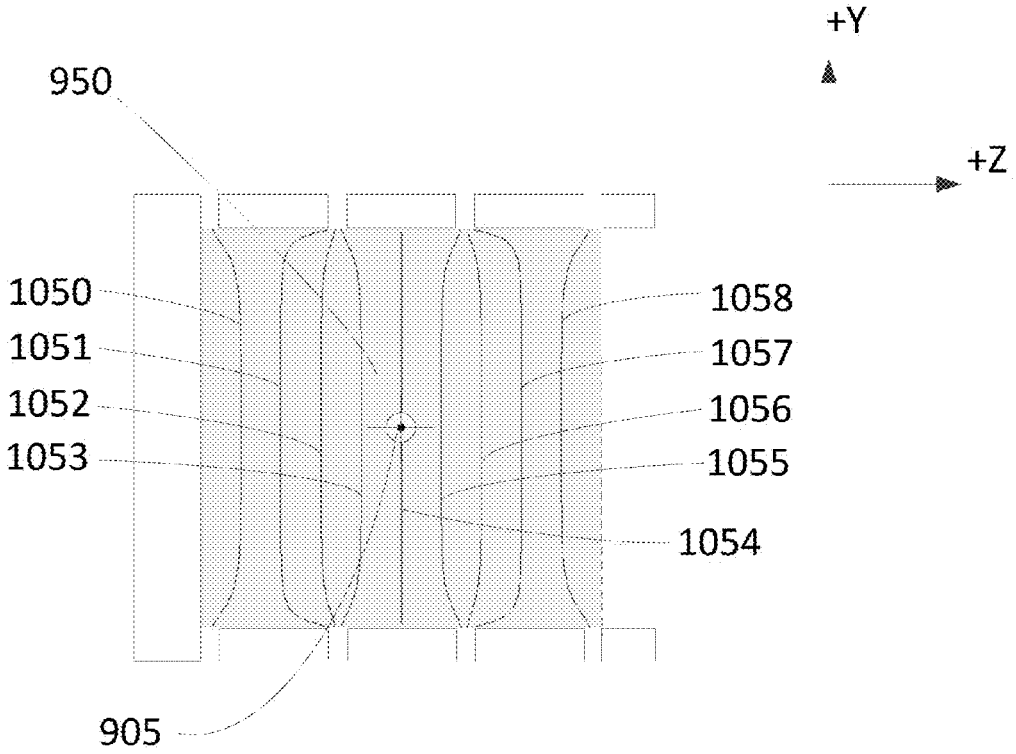
FIG. 11 is a cross-sectional view of an embodiment of a pulsing region showing equipotential contours while the pulsing region is operated in an orthogonal acceleration mode.

For the TOF pulse acceleration mode of the assembly 900 geometry of FIG. 9, it was found that essentially ideal pulse field linearity and uniformity can be achieved by applying the following pulse voltages: +Vp to pusher electrode 911; +0.64 Vp to intermediate electrode 913/916; 0 V to intermediate electrode 914/917; −0.64 Vp to intermediate electrode 915/918; and −Vp to the puller electrode 912. Nine exemplary equipotential contours calculated with these voltages are shown in FIG. 11 for potentials equally spaced between +Vp and −Vp. The potential contour 1050 is for the potential of 0.8 Vp; the potential contour 1051 is for the potential 0.6 Vp; the potential contour 1052 is for the potential 0.4 Vp; the potential contour 1053 is for the potential 0.2 Vp; the potential contour 1054 is for the potential 0 volts; the potential contour 1055 is for the potential −0.2 Vp; the potential contour 1056 is for the potential −0.4 Vp; the potential contour 1057 is for the potential −0.6 Vp; the potential contour 1058 is for the potential −0.8 Vp.

The equipotential contours are each essentially planar and equally-spaced within the central portion of the assembly 900 with high accuracy. The calculated deviation from a perfectly constant field within the central 3 mm diameter, for example, is less than 0.1%, similar to that for the geometry of FIG. 3.

In order to demonstrate the efficacy of one embodiment of the invention, the pulsing region geometry of FIG. 9 was fabricated with dimensions 931, 932, 933, and 934 all equal to 5.0 mm; and the width of electrodes 913/916, 914/917 and 915/918 were each 2.8 mm, where the gaps between them, between electrode 211 and electrodes 913/916, and between 915/918 and electrode 912 were all 0.4 mm. Intermediate electrodes 913/916, 914/917 and 915/918 were fabricated as thin film traces on a supporting printed circuit board. Grid 912 was configured as an array of ~20 μm diameter wires extending lengthwise in the X-direction of FIG. 9, with an inter-wire spacing of ~250 μm, and supported by a metal 'frame'. The length of this pulsing region structure was about 70 mm in the X-direction.

Figure 12:
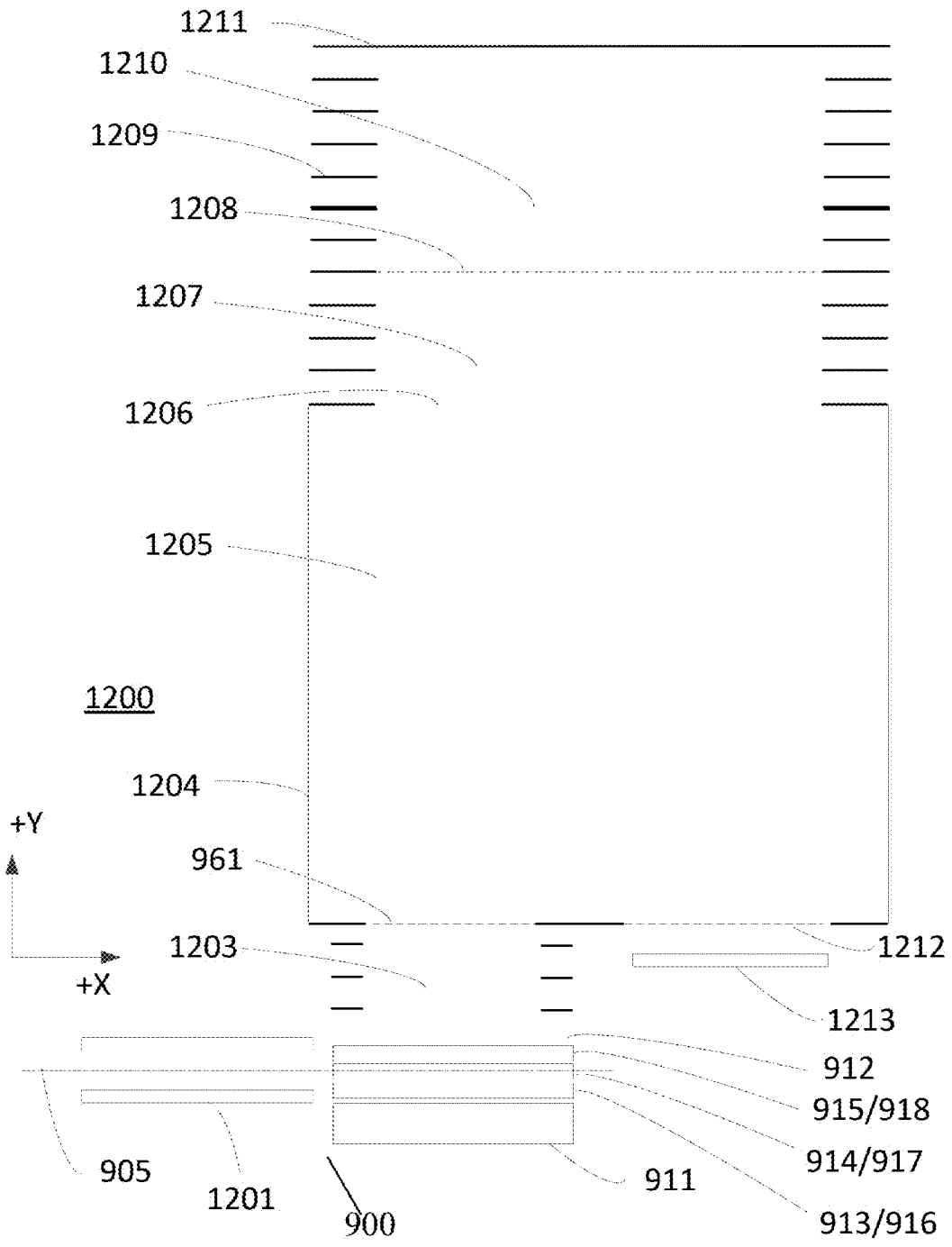
FIG. 12 is a schematic of an orthogonal acceleration time-of-flight mass analyzer incorporating the pulsing region of FIG. 9.

As depicted in the schematic outline of FIG. 12, the fabricated pulsing assembly 900 was incorporated as the first pulse acceleration stage of a two-stage orthogonal pulse-acceleration arrangement of an OA-TOF mass analyzer. The length of the second stage 1203 was about 18 mm in the +Y direction.

Primary ions were directed into pulsing region 950 along central axis 905 by transport RF ion guide 1201, which was arranged with a central axis coaxial with axis 905 of pulsing region 950, during 'filling' time period 501 shown in FIG. 8, (except that the RF voltages were provided as a sinusoidal waveform rather than the square waveform shown in FIG. 8). Ion guide 1201 was configured in the apparatus 1200 as a square RF quadrupole ion guide, along with separate and independently-controlled ion guide RF and DC offset generators (not shown). However, ion guide 1201 could also be configured as an RF ion guide having round rods with quadrupole, hexapole, or octopole symmetry, or any other RF ion guide configuration, or, alternatively, as electrostatic lenses, as is well known in the art. In the most preferred embodiment, the cross-section geometry of RF ion guide 1201 would be the same as that of assembly 900 and would have the same RF amplitude and phase applied as that for assembly 900 during the ion 'filling' phase. However, it was found to be advantageous to operate assembly 900 during the ion filling stage with an independent DC offset voltage that could be adjusted as necessary to accelerate or decelerate ions from ion guide 1201 into pulsing region 950 in order to ensure that the ideal axial kinetic energy of ions is attained in pulsing region 950.

Ions pulse-accelerated from the pulsing region 950 during the pulsing phase 503 shown in FIG. 8, were accelerated into the TOF drift tube 1204 field free region 1205 through drift tube entrance grid 961. After passing through the TOF drift tube 1204 field free region 1205, the ions passed through a reflectron entrance grid 1206. The reflectron assembly was configured as a two-stage reflectron mirror that includes: entrance grid 1206; middle grid 1208 defining the boundary between the two stages 1207 and 1210; reflectron electrode 1211; and ring electrodes 1209 that were provided voltages to ensure linear potential gradients in the Y-direction in the stages 1207 and 1210, as is well known in the art.

Ions entering the reflectron assembly through entrance grid 1206 in the +Y direction were decelerated in stage 1207, turned around in stage 1210, accelerated back through stages 1210 and 1207, and again entered drift tube 1204 field-free region 1205 as they passed through reflectron grid 1206. The ions then passed through drift tube 1204 exit grid 1212, and were accelerated to detector 1213.

The distance along the x-direction between the center of the pulsing region 950 and the center of detector 1213 was about 80 mm, while the overall dimensions of the TOF analyzer assembly was less than about 20 cm in diameter and less than about 70 cm in height, so that the TOF mass analyzer could readily be configured as a compact, benchtop instrument.

The TOF mass analyzer of FIG. 12 was incorporated into a benchtop instrument that included (not shown) a conventional electron ionization ion source, and a series of RF ion guides and vacuum stages for transporting ions from the ion source to the pulsing assembly 950. The TOF drift tube 1204 was operated with a voltage of 2 kV, and the corresponding primary beam kinetic energy was about 6 eV. During the ion 'filling' phase 501, RF voltages were applied to the electrodes 911, 912, 913/916, 914/917, and 915/918 separately which were all of the same RF voltage amplitude, with the RF voltages applied to electrodes 911 and 912 being of the same phase, while the RF voltages applied to electrodes 913/916, 914/917, and 915/918 also all being the same phase but 180 degrees different in phase from that of the RF voltages applied to electrodes 911 and 912. The DC offset voltages to which each of these RF voltages was referenced could be adjusted independently. These DC offset voltages were adjusted to compensate for slight misalignments between the primary beam axis and the axis 905 of the pulsing region 950, and to compensate for field penetration through grid electrode 912 from downstream electric field of the second pulse acceleration stage 1203.

The TOF signal produced by the TOF detector 1213 was digitized by an analog-to-digital recorder with a 250 MHz digitization rate, and a number of TOF spectra could be integrated to improve signal-to-noise, and transferred to a computer for display and/or storage on the computer disk.

An example of a portion of such a spectrum is displayed in FIG. 13A, corresponding to ions with a m/z value of 69 resulting from electron ionization of molecules of perfluorotributylamine. This data was recorded with a RF voltage amplitude of 300 V peak-to-peak (p-p), and a frequency of 1 MHz applied to the pulse assembly electrodes 911, 912, 913/916, 914/917, and 915/918. The nominal DC offset voltages applied to these electrodes was about −4 V, in order to achieve an axial kinetic energy of 6 eV, since the ions were created in the ion source at a potential of about +2 V. The DC voltage offsets applied to individual electrodes were adjusted from this nominal value so as to optimize transmission and resolution by correcting for mechanical misalignments and to counteract field penetration through puller electrode grid 912.

Figure 13:
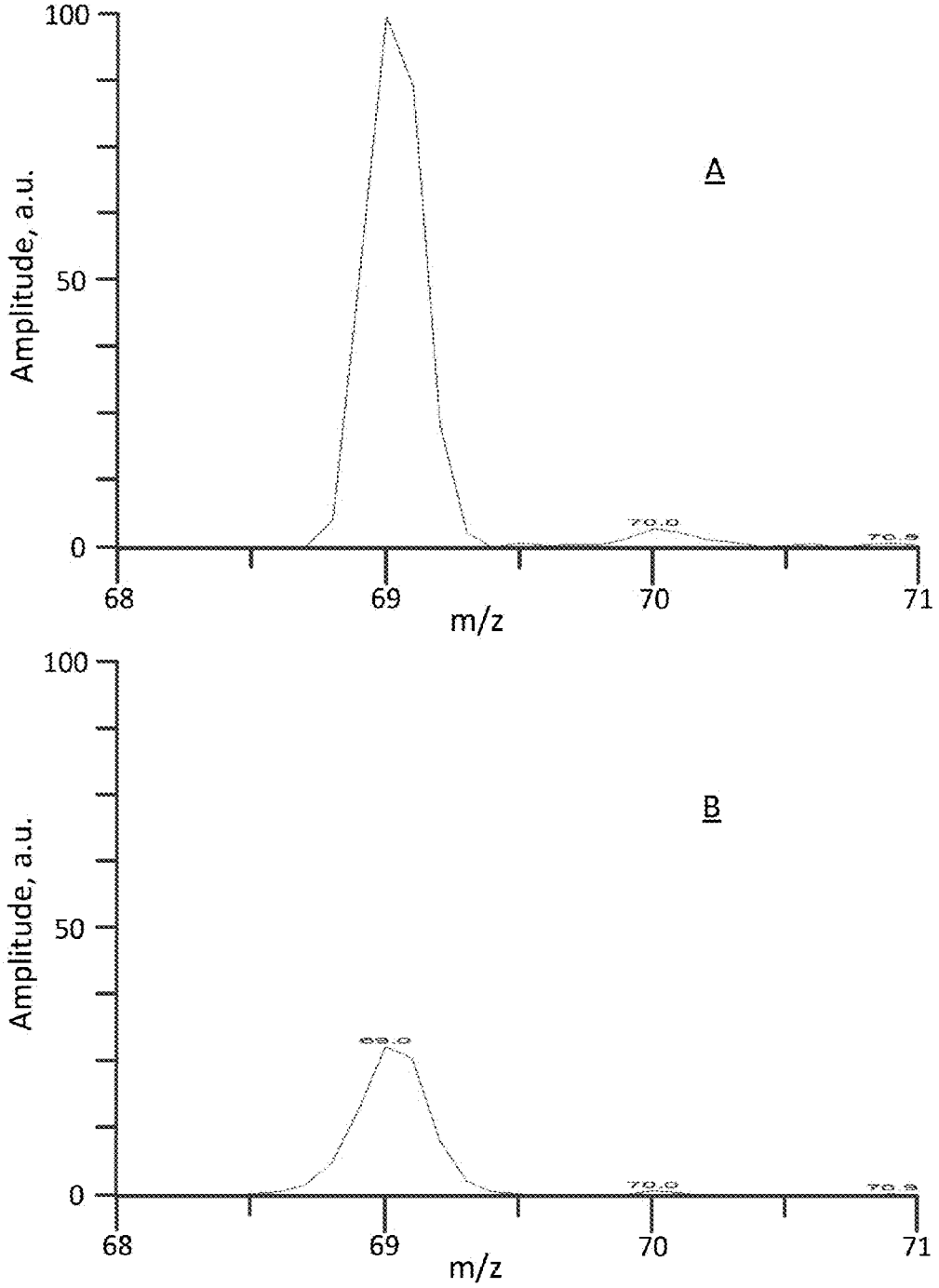
FIG. 13A is a plot of a portion of a TOF mass spectrum recorded using the OA-TOF analyzer of FIG. 12, with the pulsing region operating with RF voltages applied during the ion guide mode operation.
FIG. 13B is a plot of a portion of a TOF mass spectrum recorded using the OA-TOF analyzer of FIG. 12, with the pulsing region operating without RF voltages applied during the ion guide mode operation.

FIG. 13 B shows the same portion of the spectrum plotted with the same vertical scale as the spectrum of FIG. 13 A, taken under identical conditions, except that the RF voltages applied to the pulsing assembly electrodes 911, 912, 913/916, 914/917, and 915/918 were reduced to 0. In this case, the pulsing region 950 was essentially field free during the ion 'filling' phase 501, which is the same operation as is typically employed in conventional OA-TOF instruments. However, as a consequence of removing the RF voltages from the pulsing region 950 during the 'filling' phase 501, the recorded peak amplitude of the 69 u ion peak decreased to 0.28 of the peak amplitude recorded with the RF voltages applied with 300 V p-p amplitudes. Further, a substantial portion of the peak intensity distribution was not as well focused in time in the TOF analyzer, resulting in an increase in peak intensity in the 'wings' of the peak at its base. These results are interpreted as arising from a less focused primary ion beam in the pulsing region without the constraining action of the RF fields during the ion filling phase 501.

While embodiments configured essentially as a square quadrupole have been described, it should be understood that alternative geometries may be used. For example, ion guides comprising six, or eight, or more electrodes are well-known, and electrodes in the pulsing region may be configured accordingly. In some embodiments, for example, flat planar electrodes can be arranged such that faces of two opposing electrodes on opposite sides of the ion guide axis are normal to the TOF acceleration direction, and the one of these electrodes closest to the TOF flight tube is configured with one or more apertures through which ions may pass toward the flight tube. In an RF ion guide mode, such ion guides transmit low energy ions along the axis with RF voltages applied to the electrodes, and the ions are then pulse accelerated toward the TOF flight tube upon an abrupt transition from the RF voltages to DC voltages that are appropriately arranged to ensure an essentially constant, uniform acceleration field.

Certain embodiments have been described. Other embodiments are in the following claims.

What is claimed is:

1. A system, comprising:

an electronic controller; and a time-of-flight mass analyzer in communication with the electronic controller, the time-of-flight mass analyzer comprising:

a pulsing region defining a channel that extends along an axis, the pulsing region comprising:

a first electrode extending along the axis, the first electrode defining one or more apertures;

a second electrode extending along the axis, the first and second electrodes being positioned on opposing sides of the axis in a first direction perpendicular to the axis;

a third electrode extending along the axis; and a fourth electrode extending along the axis, the third and fourth electrodes being positioned on opposing sides of a plane defined by the axis and the first direction, wherein:

the electronic controller is programmed to apply a first set of voltages to the electrodes to constrain a motion of ions propagating along the axis in a radial direction relative to the axis, and apply a second set of voltages to the electrodes to accelerate the ions out of the pulsing region through the one or more apertures, where the first set of voltages comprises RF voltages applied to the first and second electrodes, the RF voltages being in phase with each other.

2. The system of claim 1, wherein the time-of-flight mass analyzer accelerates the ions in the first direction.

3. The system of claim 1, further comprising one or more additional pairs of electrodes extending along the axis, each pair comprising electrodes on opposite sides of the plane.

4. The system of claim 3, wherein the RF voltages applied to the one or more additional pairs of electrodes are in phase with RF voltages applied to the third and fourth electrodes.

5. The system of claim 1, wherein the first set of voltages further comprises RF voltages applied to the third and fourth electrodes that are in phase with each other.

6. The system of claim 1, wherein the RF voltages applied to the first and second electrodes are out of phase with the RF voltages applied to the third and fourth electrodes.

7. The system of claim 1, wherein the first set of voltages comprises RF voltages that have square waveforms or sinusoidal waveforms.

8. The system of claim 1, wherein the second set of voltages comprises DC voltages that establish a potential gradient in the first direction.

9. The system of claim 1, wherein the electronic controller is programmed to sequentially apply the first set of voltages and then the second set of voltages to the electrodes.

10. A method, comprising:

directing ions into a channel extending along an axis in a pulsing region of a time-of-flight mass analyzer;

applying RF voltages to electrodes extending along the axis to constrain a motion of the ions in a radial direction relative to the axis; and applying DC voltages to the electrodes to accelerate the ions out of the pulsing region in a direction orthogonal to the axis, wherein applying the RF voltages comprises applying in-phase voltages to a first pair of electrodes positioned on opposing sides of the axis in a first direction perpendicular to the axis, the first pair of electrodes comprising an electrode that defines one or more apertures through which the ions exit the pulsing region.

11. The method of claim 10, wherein applying the RF voltages further comprises applying in-phase voltages to a second pair of electrodes positioned on opposing sides of a plane defined by the axis and the first direction.

12. The method of claim 10, further comprising detecting the ions accelerated out of the pulsing region.

13. The method of claim 12, wherein the ions travel to a detector through a flight tube.

14. The method of claim 10, wherein the RF and DC voltages are repeatedly sequentially applied to the electrodes to direct a series of packets of ions out of the pulsing region.

15. A mass spectrometry system, comprising:

an ion source;

a time-of-flight analyzer assembly comprising a pulsing region, a flight tube and a detector;

an ion transport assembly arranged to receive ions from the ion source and direct the ions to the pulsing region of the time-of-flight analyzer assembly; and an electronic controller in communication with the time-of-flight analyzer assembly, wherein:

the pulsing region defines a channel that extends along an axis and the pulsing region comprises a first electrode extending along the axis, the first electrode defining one or more apertures, a second electrode extending along the axis, the first and second electrodes being positioned on opposing sides of the axis in a first direction perpendicular to the axis;

a third electrode extending along the axis; and a fourth electrode extending along the axis, the third and fourth electrodes being positioned on opposing sides of a plane defined by the axis and the first direction during operation the electronic controller causes the pulsing region to operate sequentially in a first mode, in which ions in an ion beam are confined to trajectories along an axis of the pulsing region, and a second mode, in which the ions are accelerated in a direction orthogonal to the axis into the flight tube, where the first mode comprises applying a first set of voltages to the electrodes, the first set of voltages comprising applying to the first and second electrodes RF voltages that are in phase with each other, and the second mode comprises applying a second set of voltages to the electrodes.

16. The system of claim 15, wherein the ion transport assembly comprises one or more ion guides.

17. The system of claim 16, wherein the one or more ion guides comprise one or more multiple ion guides.

18. The system of claim 15, wherein the ion transport assembly and the time-of-flight analyzer assembly are housed in one or more vacuum chambers.

19. The system of claim 15, wherein the ion source is a continuous ion source.

20. The system of claim 15, further comprising one or more additional pairs of electrodes extending along the axis, each pair comprising electrodes on opposite sides of the plane.

21. The system of claim 15, wherein the first set of voltages further comprises RF voltages applied to the third and fourth electrodes that are in phase with each other.

22. The system of claim 15, wherein the RF voltages applied to the first and second electrodes are out of phase with RF voltages applied to the third and fourth electrodes.

23. The system of claim 15, wherein the second set of voltages comprises DC voltages that establish a potential gradient in the first direction.

24. The system of claim 15, wherein the electronic controller is programmed to sequentially apply the first set of voltages and then the second set of voltages to the electrodes.

25. A method for analyzing ions using a time-of-flight mass analyzer, the method comprising:

ionizing a sample to generate ions;

directing the ions to a pulsing region of a time-of-flight mass analyzer;

providing a first electric field within the pulsing region to guide the ions along an axis within the pulsing region;

providing a second electric field within the pulsing region to accelerate the ions perpendicular to the axis and out of the pulsing region;

detecting the accelerated ions at a detector; and analyzing a mass of the ions based on a time-of-flight from the pulsing region to the detector, wherein providing the first electric field comprises applying a first RF voltage waveform to a first pair of the electrodes, the first pair of electrodes comprising an electrode that defines one or more apertures through which the ions exit the pulsing region.

26. The method of claim 25, wherein a second RF voltage waveform out of phase with the first RF voltage waveform is applied to a second pair of the electrodes.

27. The method of claim 25, wherein the second electric field is provided by applying a second set of voltages to the electrodes.

28. The method of claim 27, wherein the second set of voltages are DC voltages.

29. The method of claim 28, wherein the DC voltages cause the ions to exit the pulsing region through one or more apertures in one of the electrodes.

* * * * *

UNITED STATES PATENT AND TRADEMARK OFFICE

CERTIFICATE OF CORRECTION

PATENT NO. : 9,129,790 B2
APPLICATION NO. : 14/209982
DATED : September 8, 2015
INVENTOR(S) : David G. Welkie It is certified that error appears in the above-identified patent and that said Letters Patent is hereby corrected as shown below:

In the claims

In Col. 21, line 56, Claim 15, delete "direction" and insert -- direction, --

Signed and Sealed this
Fifth Day of April, 2016

Michelle K. Lee

Michelle K. Lee
*Director of the United States Patent and Trademark Office*